US006070970A

United States Patent [19]

Ogasawara et al.

[11] Patent Number: 6,070,970

[45] Date of Patent: Jun. 6, 2000

[54] LIQUID DISCHARGING METHOD AND LIQUID-DISCHARGE HEAD, INK-JET RECORDING METHOD AND HEAD FOR INK-JET RECORDING METHOD

[75] Inventors: Masashi Ogasawara, Kawasaki; Sadayuki Sugama, Tsukuba; Hiroyuki Ishinaga, Tokyo; Toshio Kashino, Chigasaki; Akira Nagashima, Tokyo; Yoshie Asakawa, Hotaka-machi, all of Japan

[73] Assignee: Canon Kabushiki Kaisha, Tokyo, Japan

[21] Appl. No.: 08/890,332

[22] Filed: Jul. 9, 1997

[30] Foreign Application Priority Data

Jul. 11, 1996 [JP] Japan ..... 8-181886

[51] Int. Cl.[7] ..... B41J 2/05

[52] U.S. Cl. ..... 347/65

[58] Field of Search ..... 347/65, 63, 100, 347/54

[56] References Cited

U.S. PATENT DOCUMENTS

| | | | |
|---|---|---|---|
| 4,480,259 | 10/1984 | Kruger et al. | 347/63 |
| 4,723,129 | 2/1988 | Endo et al. . | |
| 4,963,883 | 10/1990 | Matsui | 347/48 |
| 4,994,825 | 2/1991 | Saito et al. . | |
| 5,175,565 | 12/1992 | Ishinaga et al. . | |
| 5,208,604 | 5/1993 | Watanabe et al. . | |
| 5,278,585 | 1/1994 | Karz et al. | 347/65 |
| 5,389,957 | 2/1995 | Kimura et al. . | |
| 5,602,576 | 2/1997 | Murooka et al. . | |
| 5,821,962 | 10/1998 | Kudo | 347/65 |

FOREIGN PATENT DOCUMENTS

| | | | |
|---|---|---|---|
| 0 436 047 | 7/1991 | European Pat. Off. | B41J 2/055 |
| 0 721 842 | 7/1996 | European Pat. Off. | B41J 2/05 |
| 55-81172 | 6/1980 | Japan . | |
| 61-69467 | 4/1986 | Japan . | |
| 63-199972 | 8/1988 | Japan . | |
| 1-027955 | 1/1989 | Japan | B41J 3/04 |
| 1-027956 | 1/1989 | Japan | B41J 3/04 |
| 2-258263 | 10/1990 | Japan | B41J 2/05 |
| 5-169663 | 7/1993 | Japan | B41J 2/05 |

*Primary Examiner*—John Barlow
*Assistant Examiner*—Charles W. Stewart, Jr.
*Attorney, Agent, or Firm*—Fitzpatrick, Cella, Harper & Scinto

[57] ABSTRACT

Disclosed herein is a liquid discharging method, comprising using a liquid-discharge head equipped with a discharge opening from which a liquid is discharged, a first region to which a first liquid is supplied, a bubble-generating region containing a second liquid and generating bubbles in the second liquid, and a movable member which is displaceable between a first position opposite to the bubble-generating region and a second position within the first region and apart from the bubble-generating region and has a support part more upstream than its free end, in which the movable member is displaced from the first position toward the second position with the generation of a bubble in the bubble-generating region, and the bubble is guided to the discharge opening by the movable member, wherein the first liquid and the second liquid have no compatibility with each other.

45 Claims, 14 Drawing Sheets

LIQUID DISCHARGING METHOD AND LIQUID-DISCHARGE HEAD, INK-JET RECORDING METHOD AND HEAD FOR INK-JET RECORDING METHOD

BACKGROUND OF THE INVENTION

1. Field of the Invention

The present invention relates to a liquid discharging method comprising discharging a desired liquid in a desired state by using bubbles generated by applying thermal energy to the liquid, and a liquid discharging head for use in the liquid discharging method. The present invention can be preferably applied to a field of ink-jet recording technology.

The invention can be applied to equipment such as printers, copying machines, facsimiles having a communication system and word processors having a printing part, as well as industrial recording apparatuses combined with various processors, which can record on recording media such as paper, thread, fiber, cloth, leather, metals, plastics, glass, wood and ceramics.

The term "recording" as used in the present invention means not only the application of images with meaning such as letters and designs to the recording media, but also the application of such images having no meaning as patterns thereto.

2. Related Background Art

It has been known an ink-discharge recording method, so-called bubble-discharge recording method, in which the application of energy such as heat to ink causes a change of state accompanied by the rapid volumetric change (generation of bubbles) in the ink, and the ink is discharged out from the discharge opening by the working force generated from this state change, and applied to a recording medium, thereby forming an image. As disclosed in U.S. Pat. No. 4,723,129, the recording apparatus utilizing this bubble-discharge recording method is generally equipped with discharge openings for ink discharge, an ink flow path communicating with the discharge openings, and an electrothermal converting element as an energy-generating means for discharging the ink in the ink flow path.

This recording method has many merits, that is, in addition to printing of high-quality image at a high speed with slight noise, a small-sized apparatus can provides high-resolution of recorded images as well as color images, since the discharge openings for ink discharge can be arranged at a high density in a printing head. Therefore, recently the bubble-discharge recording method has been used in many office machines such as printers, copying machines and facsimiles and also in industrial systems such as textile printing apparatus.

As the bubble-discharge technology has been used in products of various fields as described above, the following various demands have been increasing in recent years.

For example, as to the demand for improvement in energy efficiency, there has been proposed the optimization of the heating element such as the thickness control of the protective film. This technique is effective in improving the propagation efficiency of the generated heat to the liquid.

In order to obtain high-quality images, there are proposed drive conditions for the liquid-discharge process with a high ink discharge speed as well as good ink discharge based on the stable bubble generation and the like. For the high speed recording, there is proposed an improved flow path form to provide a liquid-discharge head which can refill the liquid flow path with the liquid in a high speed after the liquid discharge.

For the flow path forms, flow path structures illustrated in FIGS. 23A and 23B are disclosed in Japanese Patent Application Laid-Open No. 63-199972 etc. The flow path structure and production process of the head described in this publication were invented by paying attention to the back wave (pressure toward the direction opposite to the discharge opening, i.e., pressure toward a liquid chamber 12) generated with the generation of bubbles. This back wave is an energy loss because it is not energy toward the discharging direction.

The invention illustrated in FIGS. 23A and 23B discloses valve 10, separated from a bubble-generating region which is defined by heating element 2, and situated opposite to discharge opening 11 in relation to the heating element 2.

In FIG. 23B, it is disclosed that the valve 10 produced by a production method making use of a plate sticks on the top of flow path 3 in the initial position, and hangs down within the flow path 3 with the generation of bubbles. The invention discloses that the loss of energy is prevented by controlling a part of the above-described back wave by the valve 10.

In this structure, however, the control of a part of the back wave by the valve 10 is not practical for the liquid discharge, apparent from studying the generation of bubbles within the flow path 3 holding the liquid to be discharged. The reason is as follows.

As described above, the back wave itself is not directly related to the discharge. At the time the back wave occurs within the flow path 3, the pressure from the bubble involved in the discharge has already made the liquid ejectable from the flow path 3 as illustrated in FIG. 23B. Accordingly, it is apparent that the control of a part of the back wave does not exert a great influence on the discharge.

On the other hand, in the bubble-discharge recording method, deposit is formed on the surface of the heating element due to the scorching ink since heating is repeated in the presence of the ink. Depending on the ink used, the deposit is formed in a large amount, and so the generation of bubbles becomes unstable. Therefore, sometimes there have been difficulties in successfully discharging the ink. Besides, there has been a demand for a good discharge method without the deterioration of the liquid to be discharged even when the liquid is heat-liable or has difficulty in sufficient bubble formation.

From such a point of view, a process in which the liquid which generates bubbles by heating (bubbling liquid) and the liquid to be discharged (discharge liquid) are different, and the discharge liquid is discharged by the transmitted pressure generated by bubbling of the bubbling liquid has been disclosed in, for example, Japanese Patent Application Laid-Open Nos. 61-69467 and 55-81172, and U.S. Pat. No. 4,480,259. According to these publications, an ink as the discharge liquid and the bubbling liquid are completely separated from each other by a flexible membrane such as silicone rubber to prevent the discharge liquid from direct contact with the heating element, and the pressure generated by the bubbling of the bubbling liquid is transmitted to the discharge liquid by deformation of the flexible membrane. Such a construction permits the prevention of deposit formation on the surface of the heating element and the improves the freedom of the selection of the discharge liquid.

However, in a head where the discharge liquid is completely separated from the bubbling liquid as described above, a considerable amount of the pressure generated by bubbling is absorbed in the flexible membrane because the pressure upon bubbling is transmitted to the discharge liquid by the deformation of the flexible membrane by expansion or shrinkage. Besides, since the amount of deformation of the flexible membrane is not very great, there has been a possibility that energy efficiency and discharging force may be lowered although the separation of the discharge liquid from the bubbling liquid is effective.

SUMMARY OF THE INVENTION

The inventors of the present invention has made a completely novel invention to actively control bubbles in a system where a liquid is discharged by formed bubbles (particularly, bubbles from film boiling) in a liquid flow path, based on the novel viewpoint, and filed a patent application. The principal object of the invention is the enhancement of fundamental discharge properties to a level which is unpredictable in a conventional system. In that invention, the bubbles are controlled by a movable member which is provided opposite to the heating element or the bubble-generating region, with its free end downstream from the supporting point, i.e., the discharge opening side. This invention has disclosed that the discharge efficiency and discharge rate can be improved by efficiently leading the downstream growth components of the bubble toward the discharge direction, considering the energy given to the discharge by the bubble itself, and the growth components of the bubble in the downstream direction.

In view of the prior invention described above, the present inventors have found that, instead of forming a phase separation structure to substantially separate the moving region of the movable member from the bubble-generating region, selection of liquids to be used can solve the problem of the unstable phase state due to the structural variation, or can loosen the structure design conditions.

The present invention has been completed on the basis of these findings. Main objects of the present invention are as follows.

A first object of the present invention is to ensure in the head the separated state of the liquid supplied to the bubbling region and the liquid not passing through the bubbling region, utilizing the property difference between these liquids, thereby to distinguish functional difference of these liquids, expanding the advantage due to the use of these two liquids.

A second object of the present invention is to suitably select the combination of the above-described two liquids, thereby providing a technique by which bright and high-quality recording can be achieved.

A third object of the present invention is to provide a technique by which good gloss can be imparted to the resulting recorded image.

The above objects can be achieved by the present invention described below.

According to an aspect of the present invention, there is provided a liquid discharging method comprising the steps of: providing a liquid-discharge head comprising: a liquid-discharging opening; a first region containing a first liquid; a bubble-generating region where a second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening; and discharging at least the first liquid from the liquid discharging opening, wherein the first and the second liquids have no compatibility with each other.

According to another aspect of the present invention, there is also provided a liquid discharge head comprising a liquid-discharging opening; a first region containing a first liquid; a bubble-generating region where a second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening, wherein the first and the second liquids have no compatibility with each other.

According to further aspect of the present invention, there is provided a liquid discharging method comprising the steps of: providing a liquid-discharge head comprising: a liquid-discharging opening; a first region containing a first liquid; a bubble-generating region where a second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening; and discharging at least the first liquid from the liquid discharging opening, wherein the first region and the second region are substantially closed each other when the movable member is in the first position, and wherein the first and the second liquids have no compatibility with each other.

According to further aspect of the present invention, there is provided a liquid-discharge head comprising: a liquid-discharging opening; a first region containing a first liquid; a bubble-generating region where a second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening, wherein the first region and the second region are substantially closed each other when the movable member is in the first position, and wherein the first and the second liquids have no compatibility with each other.

According to further aspect of the present invention, there is provided an ink-jet recording method comprising: providing a liquid-discharge head comprising: a liquid-discharging opening; a first region containing a first liquid; a bubble-generating region where a second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening; and discharging at least the first liquid from the liquid discharging opening, wherein the first region and the second region are substantially closed each other when the movable member is in the first position, and wherein the first and the second liquids have no compatibility with each other, and wherein the first liquid is an ink containing a coloring material.

According to further aspect of the present invention, there is provided a head for ink-jet head comprising: a liquid-discharging opening; a first region containing a first liquid; a bubble-generating region where a second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening, wherein the first region and the second region are substantially closed each other when the movable member is in the first position, and wherein the first and the second liquids have no compatibility with each other, and wherein the first liquid is an ink containing a coloring material.

Examples of the combination of the first liquid and the second liquid may include the following combinations:

1) a combination where the first liquid is an amphoteric ink, and the second liquid is a hydrophilic ink;
2) a combination where the first liquid is an amphoteric ink, and the second liquid is a hydrophobic ink;
3) a combination where the first liquid is a hydrophilic ink, and the second liquid is an amphoteric ink;
4) a combination where the first liquid is a hydrophobic ink, and the second liquid is an amphoteric ink; and
5) a combination that one of the first liquid and the second liquid is a hydrophilic ink, and the other is a hydrophobic ink.

According to the present invention, two liquids not mixed with each other are held in the same head while ensuring their separation, whereby the advantage of using these two liquids can be more effectively exhibited. Further, when the combination of these liquids is suitably selected, the occurrence of bleeding can be more effectively prevented, and bright and high-quality recording can be carried out. Besides, according to such constitution, thickening and crusting at the discharge openings of the head can be prevented more effectively. In addition, good gloss can be imparted to the resulting recorded image.

In addition, according to the present invention, even though a small quantity of the second liquid is remained in the first region after the liquid discharge with a displacement of the free end of the movable member, the remained liquids separate and reunite each other and the second liquid returns to the bubble-generating region due to the incompatibility of the first and the second liquids, and the separated state is resumed automatically. As a result, quality of droplets for liquid discharge can be stabilized.

Further, according to the present invention, a synergistic effect of a bubble generated and the movable member displaced by the bubble can be obtained, and so a liquid in the vicinity of the discharge opening can be efficiently discharged. Therefore, discharge efficiency can be improved compared with the conventional discharge methods and conventional heads of the bubble-discharge system. For example, in the most preferred embodiment of the present invention, the discharge efficiency can be improved at least 2 times by leaps and bounds.

According to this characteristic constitution of the present invention, discharge failure can be prevented even when a recording apparatus is left over for a long period of time at a low temperature and a low humidity. There is also an advantage that even when discharge fails, normal state can be immediately recovered by slight recovery operation such as preliminary discharge or suction.

According to the constitution of the present invention with particular improvement in refilling ability, good responsiveness, stable bubble growth and stabilization of droplets upon continuous discharge can be achieved, whereby high-speed recording or high-quality recording can be practiced with a high-speed liquid discharge.

The above and other objects, features and advantages of the present invention will become apparent from the following description and the appended claims, taken in conjunction with the accompanying drawings.

Incidentally, the terms "upstream" and "downstream" as used herein represent the flow direction of a liquid from the supply source toward the discharge opening via the bubble-generating region or the movable member, or the constitutional directions.

Besides, the term "downstream side" with a bubble means the part of the bubble on the discharge opening side, which is thought to directly work on the discharge of a droplet. More specifically, it means the downstream from the center of the bubble in the above-described flowing direction or constitutional direction, or a bubble generated in a region on the more downstream side than the center of the heating element.

Further, the term "substantially closed" as used herein means a state that when a bubble grows, it does not pass through a slit around the movable member before the movable member is displaced.

Further, the term "partition wall" as used herein means in a broad sense a wall (may include the movable member) interposing so as to distinguish the bubble-generating region from the region directly communicating with the discharge opening, or in a narrow sense a wall which distinguishes a flow path including the bubble-generating region from a liquid flow path directly communicating with the discharge opening and prevents liquids present in the respective regions from mixing with each other.

DETAILED DESCRIPTION OF THE PREFERRED EMBODIMENTS

Figure 1A:
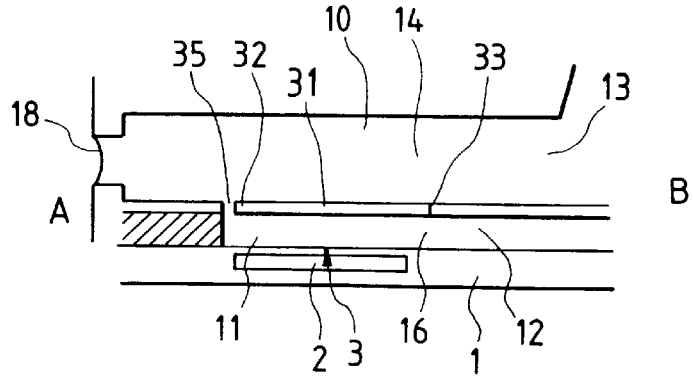
FIGS. 1A, 1B, 1C and 1D are schematic cross-sectional views illustrating an exemplary liquid-discharge head making use of a movable member.

The present invention will hereinafter be described in detail with reference to the drawings.

The functions of the movable member utilized in the present invention will be explained with reference to the drawings, more specifically, an example where liquid-discharging force and efficiency for discharging a liquid are improved by controlling the propagation direction of pressure from a bubble and the growing direction of the bubble will be described. Incidentally, the following examples are described on the premise that liquid flow paths expanding to the displacement region of a movable member or to a bubble-generating region from a liquid supply tank are separated from one another.

FIGS. 1A to 1D are schematic cross-sectional views taken in the direction of the liquid flow paths of a liquid-discharge head containing a movable member.

In the liquid-discharge head, a heating element 2 (in this example, a heating resistor of 40 $\mu$m×105 $\mu$m in dimensions, which serves as a discharge-energy-generating element for discharging a liquid by transmitting thermal energy to the liquid, is provided on an element substrate 1, and a liquid flow path 10 is located over the element substrate 1 facing the heating element 2. The liquid flow path 10 also connects discharge opening 18 and common liquid chamber 13 for supplying plural liquid flow paths 10 with the liquid, thereby receiving the liquid supply in an amount corresponding to the liquid discharged from the discharge opening from the common liquid chamber 13.

A movable member 31 in the form of a plate having a flat part, which is composed of a material having elasticity, such as a metal, is cantilevered in the liquid flow path 10 over the element substrate 1 so as to face the heating element 2. An end of this movable member is fixed to a base (support member) 34 or the like formed on the wall of the liquid flow path 10 or the element substrate by patterning a photosensitive resin or the like, whereby the movable member is held, and a supporting point (support part) 33 is constructed.

The movable member 31 is positioned about 15 $\mu$m apart from the heating element 2 in a state covering or facing the heating element 2 in such a manner that it has free end (free end part) 32 on the downstream side of the supporting point 33 in the stream of the liquid which flows from the common liquid chamber 13 to the discharge opening 18 over the movable member 31 with the discharging operation of the liquid. A bubble-generating region is defined between the heating element 2 and the movable member 31. Incidentally, the kinds, forms and arrangement of the heating element and the movable member are not limited to those described above. Any forms and arrangement may be used so far as they can control the growth of a bubble and the propagation of the pressure as described below. Considering the liquid flow, which will be made subsequently, the above-described liquid flow path 10 is divided into two regions of a first liquid flow path 14 directly communicating with the discharge opening 18, and a second liquid flow path 16 including the bubble-generating region 11 and a liquid supply path 12 for the description thereof.

The liquid in the bubble-generating region 11 defined between the movable member 31 and the heating element 2 is heated by the heating element 2 to generate a bubble in the liquid on the basis of the film boiling phenomenon as described in U.S. Pat. No. 4,723,129. The pressure from the bubbling and the bubble itself preferentially act on the movable member, and the movable member is displaced so as to widely open toward the discharge opening side with the supporting point 33 as a center as illustrated in FIGS. 1B and 1C. Depending on the displacement of the movable member 31 or its displaced state, the pressure from bubbling is propagated to the discharge opening side, and the growth of the bubble itself is guided thereto.

A fundamental discharge principle when the above-described movable member is used will hereinafter be described. One of the most important principles in this discharge process is that the movable member located so as to face the bubble is displaced from a first position in a stationary state to a second position after the displacement by the pressure generated by the bubble or the bubble itself, while the pressure and the bubble itself are guided toward the downstream side, where the discharge opening is arranged, by the displaced movable member 31.

Figure 2:
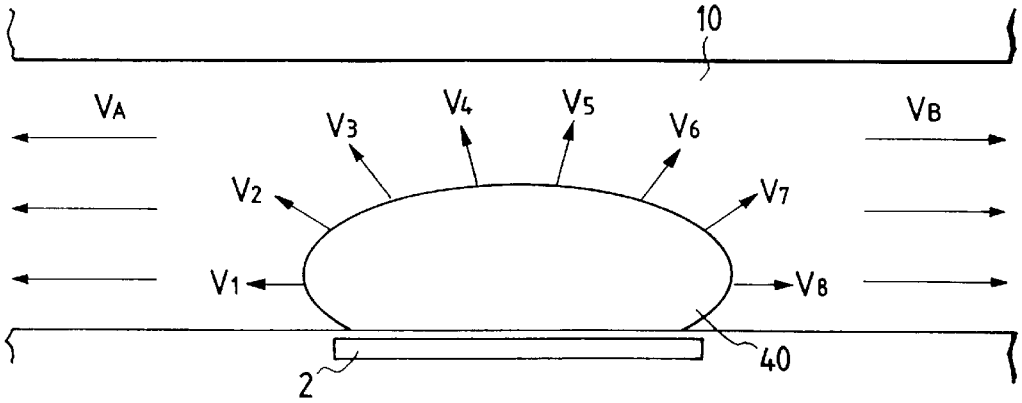
FIG. 2 PRIOR ART
FIG. 2 schematically illustrates the propagation of pressure from a bubble generated in a conventional head.
Figure 3:
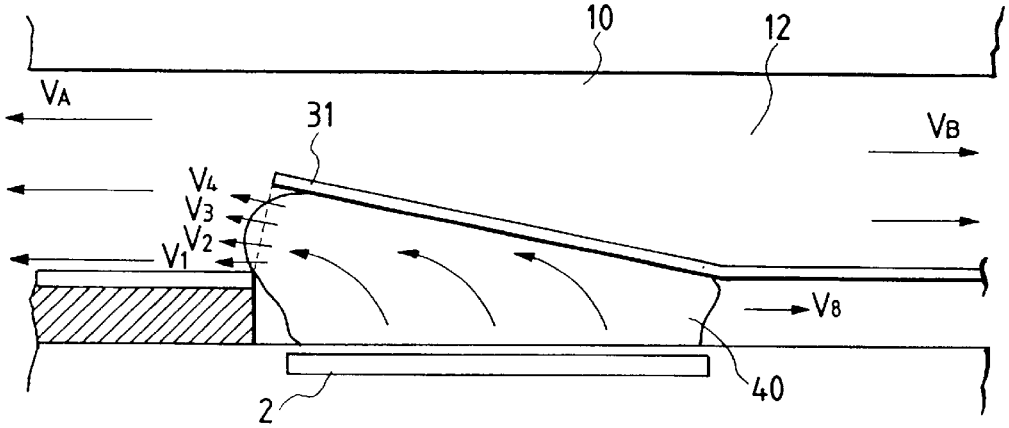
FIG. 3 schematically illustrates the propagation of pressure from a bubble generated in the head making use of the movable member.

This principle is described in more detail comparing FIG. 2, which schematically illustrates the structure of a conventional liquid flow path having no movable member, with FIG. 3 one having a movable member. Here, the propagation directions of the pressure toward the discharge opening and toward the upstream side are represented by $V_A$ and $V_B$, respectively.

In such a conventional head as illustrated in FIG. 2, there is no construction capable of regulating the propagating direction of the pressure from bubble 40. Therefore, the pressure propagation directions of the bubble 40 are perpendicular to the bubble surface as represented by $V_1$ to $V_8$ and hence various. The pressure propagation directions, e.g., $V_1$ to $V_4$, those having a component of VA direction are most effective in the liquid discharge, that is, the pressure propagation directions of a half of the bubble, from the bubble center toward the discharge opening. They are important since they directly contribute to the liquid discharge efficiency, liquid discharging force, discharge rate and the like. Further, $V_1$ is closest to the discharge direction $V_A$, and hence most effective. On the contrary, the VA direction component of $V_4$ is relatively small.

On the other hand, when a movable member illustrated in FIG. 3 is used, movable member 31 guides the pressure-propagating directions $V_1$ to $V_4$ of a bubble, which are pointing to various directions in FIG. 2, toward the downstream side (discharge opening side) converting them toward the pressure-propagating direction $V_A$, whereby the pressure from the bubble 40 directly and efficiently contributes to the discharge. The growing direction of the bubble itself is also guided to the downstream direction like the pressure-propagating directions $V_1$ to $V_4$, so that the bubble grows larger in the downstream direction than in the upstream direction. As described above, the growing direction of the bubble is controlled by the movable member to control the pressure-propagation directions of the bubble, whereby discharge efficiency, discharging force, discharge rate and the like can be fundamentally improved.

The discharge operation of the liquid-discharge head making use of the movable member will be described in detail, referring to FIGS. 1A to 1D.

Figure 1B:
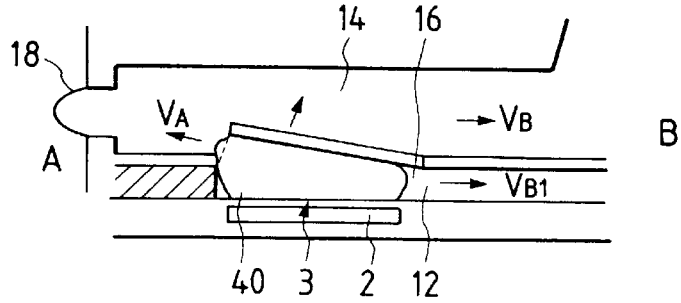
Figure 1C:
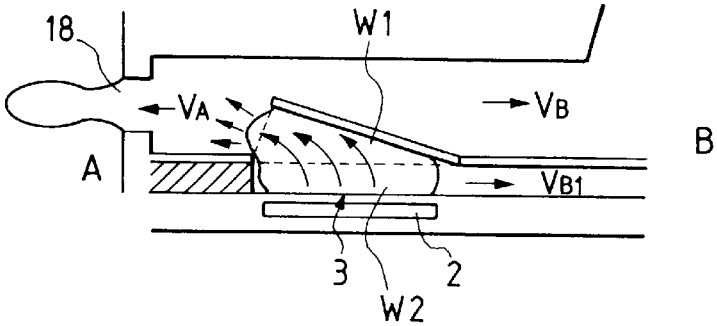

FIG. 1A illustrates a state before energy such as electric energy is applied to the heating element 2, i.e., a state before the heating element 2 generates heat. Here, it is important that the movable member 31 is provided at a position that the movable member 31 will face at least a downstream half of a bubble which is generated by heating of the heating element 2. Namely, from the viewpoint of the structure of a liquid flow path, the movable member 31 extends more downstream than at least the area center 3 of the heating element (than a line which goes through the area center 3 of the heating element and is perpendicular to the longitudinal direction of the liquid flow path) in such a manner that the downstream half of the bubble would act on the movable member.

FIG. 1B illustrates a state that energy such as electric energy has been applied to the heating element 2 to generate heat, a part of the liquid in the bubble-generating region 11 has been heated, and a bubble is generated by film boiling.

At this point, the movable member 31 is displaced from the first position toward the second position by a pressure based on the generation of the bubble 40 so as to guide the pressure-propagating directions of the bubble toward the direction of the discharge opening. Here, it is important to position the free end 32 of the movable member 31 downstream (discharge opening side), and its supporting point 33 upstream (common liquid chamber side) as described above, so that at least a part of the movable member faces the downstream portion of the heating element, i.e., the downstream portion of the bubble.

FIG. 1C illustrates a state that the bubble 40 has grown more, and the movable member 31 has been more displaced according to the pressure of the bubble 40. The generated bubble grows larger in the downstream direction than in the upstream direction, and is growing over the first position (a position indicated by a broken line) of the movable member.

It is considered that the discharge efficiency may be improved by the gradual displacement of the movable member 31 according to the growth of the bubble 40, since the shifted pressure-propagating directions and the shifted volume of the bubble 40, namely, the bubble growth toward the free end, can be evenly guided toward the discharge opening. The movable member scarcely prevents the propagation while the bubble and the pressure by the bubble are guided in the direction of the discharge opening, so that the direction of pressure propagation and the bubble growth can be efficiently controlled in accordance with the intensity of the pressure to be propagated.

Figure 1D:
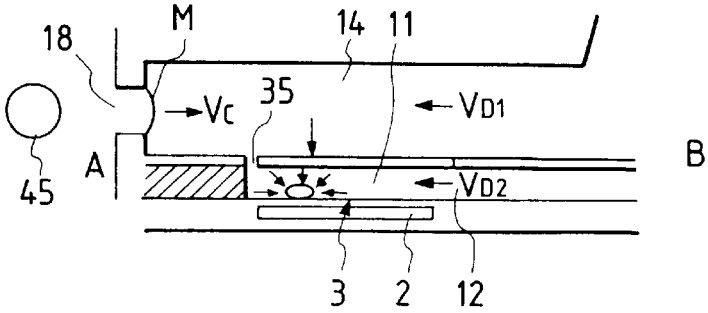

FIG. 1D illustrates a state where the bubble 40 has deflated and vanished due to the reduction of the pressure inside the bubble after the above-described film boiling ceased.

The movable member displaced to the second position is returned to the initial position (first position) in FIG. 1A by the negative pressure due to the deflation of the bubble and the restoring force due to the springiness of the movable member itself. Upon the vanishment of the bubble, in order to supply the volume of the deflated bubble in the bubble-generating region 11 and the volume of the discharged liquid, the liquids flow into the respective regions from the upstream side B, i.e., the respective common liquid chambers, streams $V_{D1}$ and $V_{D2}$, and from the discharge opening side, stream $V_C$.

Next to the operation of the movable member and the discharging operation of the liquid upon the bubbling as described above, the refilling of the liquid in the liquid-discharge head making use of the movable member will now be described in detail.

The mechanism of the liquid supply where the movable member is present is described in more detail with reference to FIGS. 1A to 1D.

When the bubble 40 enters the deflating phase via the state of the maximum volume after the process illustrated in FIG. 1C, the liquid in an amount corresponding to the volume of the vanished bubble flows into the bubble-generating region from the first liquid flow path 14 of the discharge opening side and from the common liquid chamber 13 via the second liquid flow path 16. In the structure of the conventional liquid flow path having no movable member 31, the amounts of the liquid flowing into the vanished position of the bubble from the discharge opening side and from the common liquid chamber side depend on the flow resistance in the region from the bubble-generating region to the discharge opening and in the region from the bubble-generating region to the common liquid chamber (based on the flow path resistance and the inertia of the liquid).

Therefore, when the flow resistance on the discharge opening side is low, a large amount of the liquid flows into the site of the vanished bubble from the discharge opening side, so that the regress of the meniscus becomes great. In particular, if the discharge efficiency is improved by reducing the flow resistance near the discharge opening, the meniscus regress becomes greater upon the vanishment of the bubble, so that the refilling time becomes long, preventing high-speed printing.

On the other hand, the movable member 31 is provided in this embodiment, the regress of the meniscus is stopped at the point when the movable member returns to the original position upon the vanishment of the bubble, and the liquid corresponding to the volume(W2) of the remaining lower portion of the bubble is supplied mainly from the stream $V_{D2}$ in the second liquid flow path 16. Here W is the volume of the entire bubble, W1 is the volume of the bubble over the first position of the movable member 31 and W2 is the volume of the remaining portion on the side of the bubble-generating region 11. Therefore, the degree of the regress of the meniscus in the conventional head corresponds to about a half of the volume W, while the degree of meniscus regress in this embodiment can be reduced to about a half of the volume W1, smaller than that.

The liquid supply corresponding to the volume W2 can be forcibly conducted mainly from the upstream side ($V_{D2}$) in the second liquid flow path along the surface of the movable member 31 on the heating element side utilizing the negative pressure generated upon the vanishment of the bubble, so that faster refilling can be realized.

In the conventional head, the oscillation of the meniscus becomes greater when refilling is conducted using the negative pressure upon the vanishment of the bubble, resulting in the deterioration of image quality. On the other hand, according to this embodiment, the oscillation of the meniscus can be lessened significantly in the high-speed refilling because the movable member inhibits the communication between the liquid on the discharge opening side of the first liquid flow path 14 and the liquid in bubble-generating region 11.

With such a movable member, stable discharge, high-speed repeated discharge, and when used in the recording, improvement in image quality and high-speed recording can be realized by high speed refilling due to the forced refilling into the bubble-generating region through the liquid supply path 12 into the second liquid flow path 16, and the above-described control of the regress and oscillation of the meniscus.

The constitution with the movable member further combines the following effective function, namely, prevention of the pressure propagation toward the upstream side (back wave) upon bubbling. Of pressure components from the bubble generated on the heating element 21, most components at the upstream portion of the bubble (portion on the side of the common liquid chamber 13) act as force pushing back the liquid toward the upstream side (back wave). This back wave presses the liquid upstream, causing liquid movement and force of inertia with the liquid movement. These actions reduce the refilling of the liquid into the liquid flow path and prevent high-speed drive. When the movable member is used, these actions on the upstream side can be prevented by the movable member 31, whereby refilling ability is further improved.

Next, further structure characteristics and effects with the movable member are described.

The second liquid flow path 16 has the liquid supply path 12 having an inner wall connected to the heating element 2 at substantially the same level (the surface of the heating element is not caved in much). In such a case, the supply of the liquid to the bubble-generating region 11 and the surface of the heating element 2 is conducted like $V_{D2}$ along the surface of the movable member 31 on the side near the bubble-generating region 11. Therefore, the liquid is prevented from stagnating on the surface of the heating element 2, so that it is easy to prevent the deposition of the gas dissolved in the liquid, and easy to remove so-called remaining bubble not vanished, as well as the prevention of excess heat accumulation in the liquid. Accordingly, the more stable bubbling can be conducted repeatedly at a high speed. In this embodiment, the description has been made with the liquid-discharge head which has the liquid supply path 12 having an inner wall at substantially the same level as the surface of the heating element 2. However, the liquid supply path is not limited to this structure, and any liquid supply path may be used so far as it is smoothly connected to the heating element, has a smooth inner wall and is in a form not causing the stagnation of the liquid on the heating element or great turbulent flow in the supply of the liquid.

The supply of the liquid to the bubble-generating region may also be conducted through a side (a slit 35) of the movable member from the stream $V_{D1}$. However, when a large movable member which covers the whole bubble-generating region (over the surface of the heating element) is used as illustrated in FIGS. 1A to 1D, in order to more effectively guide the pressure upon bubbling to the discharge opening, the flow resistance of the liquid between the bubble-generating region 11 and the region near the discharge opening in the first liquid flow path 14 becomes higher upon the return of the movable member 31 to the first position. Thus, the flow of the liquid toward the bubble-generating region 11 from the stream $V_{D1}$ is obstructed. In the head structure making use of such a movable member, there is a stream $V_{D2}$ for supplying the liquid to the bubble-generating region with high efficiency, so that the performance in the liquid supply is not lowered by adopting the structure that covers the bubble-generating region 11 with the movable member 31 to achieve high discharge efficiency.

With respect to the positions of the free end 32 and the supporting point 33 of the movable member 31, the free end is situated more downstream than the supporting point. Such a construction can efficiently realize functions and effects such that the pressure-propagation directions and growing direction of the bubble are guided on the side of the discharge opening upon bubbling as described above. Further, this positional relationship is effective not only in the discharge functions and effects, but also effective in reducing the flow resistance against the liquid flowing through the liquid flow path 10 upon refilling at a high speed. This is due to the fact that the free end 32 and the supporting point 33 are arranged so as not to go against the streams $V_{D1}$ and $V_{D2}$ flowing through the liquid flow path 10 (including the first liquid flow path 14 and the second liquid flow path 16) when the regressed meniscus upon discharge returns to the discharge opening 18 by capillary force, or the liquid is supplied upon the vanishment of the bubble.

Supplementarily described, in FIGS. 1A to 1D, the free end 32 of the movable member 31 extends over the heating element 2 so as to oppose it at a position more downstream than the area center 3 which divides the heating element 2 into an upstream region and a downstream region (a line which goes through the area center 3 (the center) of the heating element and is perpendicular to the longitudinal direction of the liquid flow path), whereby the movable member 31 can catch the pressure or bubble, which is generated on the more downstream side than the area center 3 of the heating element and greatly contributes to the discharge of the liquid, to guide the pressure and bubble to the discharge opening, and so the discharge efficiency and discharge force can be fundamentally enhanced.

In addition, the upstream portion of the bubble is also utilized to achieve further effects. It is considered that the fact that the free end of the movable member 31 undergoes momentary mechanical displacement effectively contributes to the discharge of the liquid.

Figure 4:
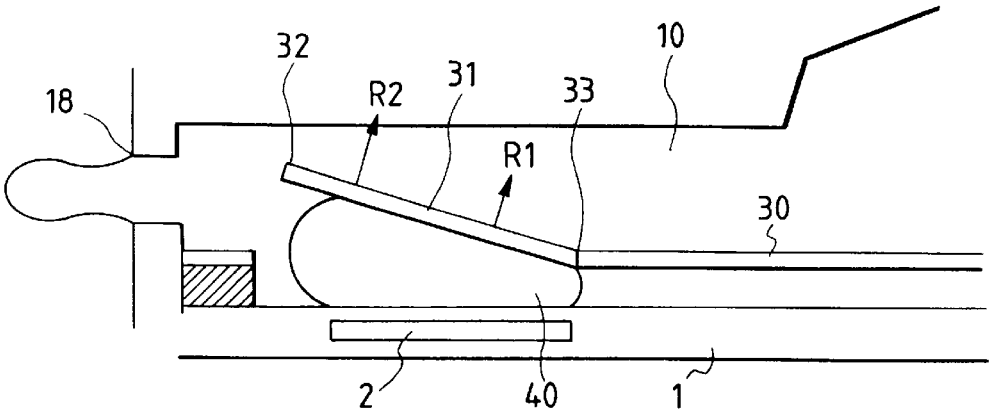
FIG. 4 is a cross-sectional view of another exemplary liquid-discharge head making use of a movable member.

An example where the force for discharging the liquid is further enhanced by the above-described mechanical displacement is illustrated in FIG. 4. FIG. 4 is a transverse cross-sectional view illustrating the structure of such a head. FIG. 4 illustrates a case where a movable member 31 extends in such a manner that the position of the free end of the movable member 31 is more downstream than the heating element 2. This arrangement increases the displacing speed of the movable member at the free end and further enhancing the generation of discharging force due to the displacement of the movable member.

Besides, since the free end is close to the discharge opening side in comparison with the previous case, the growth of a bubble can be concentrated to more stable directional components, and more excellent discharge can be performed.

Although the movable member 31 is displaced at a displacement rate R1 in proportion to the bubble growth rate at the pressure center of the bubble, the free end 32 situated further than this point from a supporting point 33 is displaced at a higher rate R2, whereby the free end 32 can mechanically act on the liquid at a high speed to cause liquid movement, thereby enhancing discharge efficiency.

When the shape of the free end is made perpendicular to the liquid flow, the pressure by the bubble and the mechanical action of the movable member can be caused to more efficiently contribute to the discharge of the liquid.

The present invention can be constituted by applying the discharge system using the above-described movable member. The head used in the present invention has the construction, features and discharge principle in the head using the above-described movable member, and in addition to these fundamental items, the present invention has a feature that the liquid flow path is divided into a first liquid flow path and a second liquid flow path, a first liquid supplied to the first liquid flow path is separated from a second liquid supplied to the second liquid flow path for bubbling upon heating.

Figure 5:
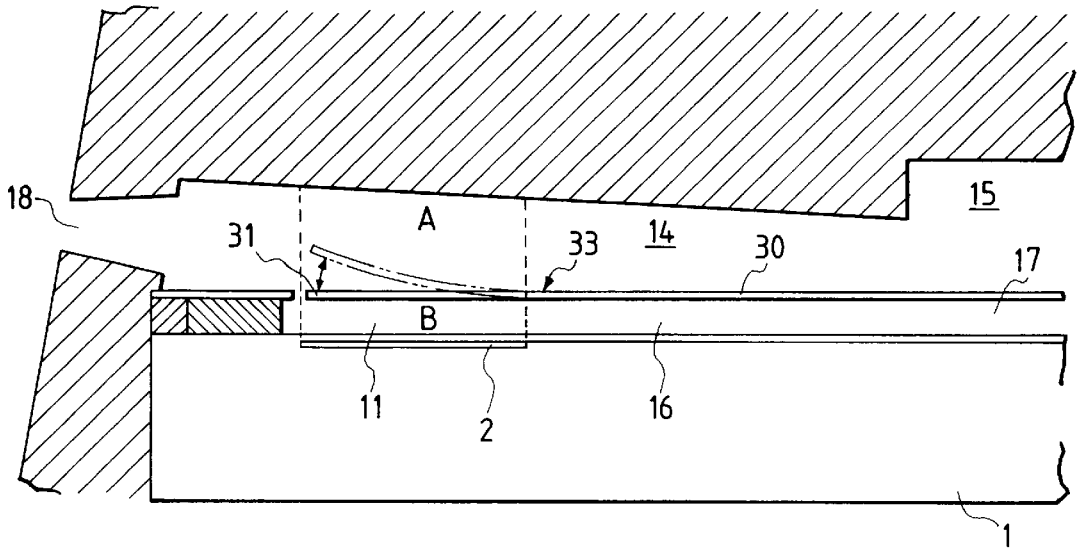
FIG. 5 is a schematic cross-sectional view of a liquid-discharge head according to an embodiment of the present invention.
Figure 6:
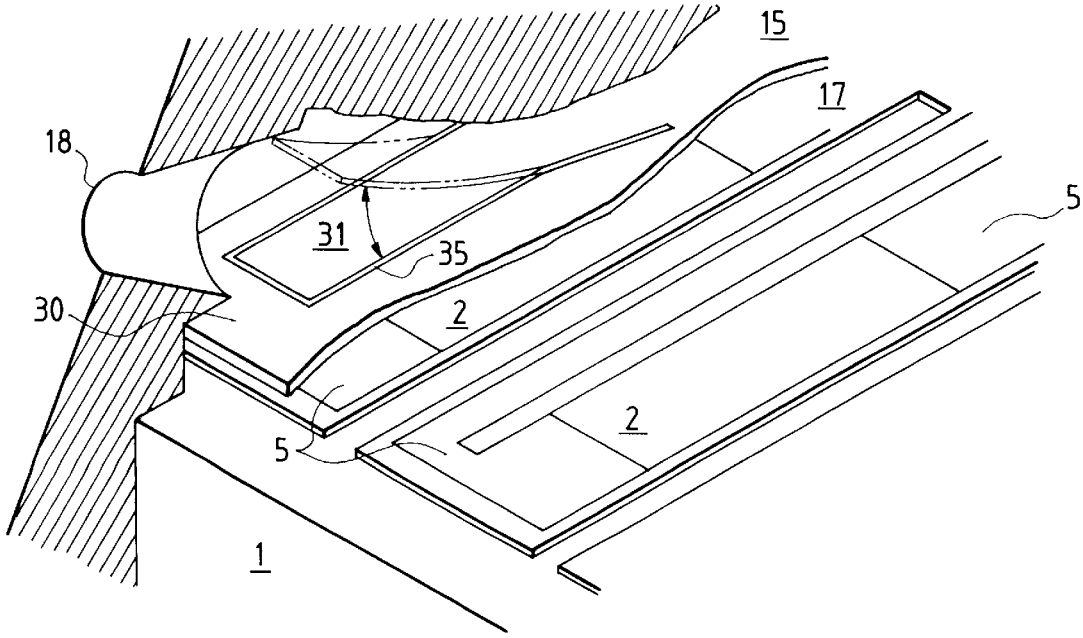
FIG. 6 is a perspective view, partially broken away, of the liquid-discharge head according to the embodiment of the present invention.

FIG. 5 illustrates a schematic cross-sectional view, taken along the liquid flowing direction, of a liquid-discharge head according to another embodiment of the present invention, and FIG. 6 illustrates a perspective view, partially broken away, of the liquid-discharge head.

In the liquid-discharge head according to this embodiment, a second liquid flow path 16 for bubbling is arranged over an element substrate 1 provided with a heating element 2 which applies thermal energy for bubbling to a liquid, and a first liquid flow path 14 directly communicating with a discharge opening 18 is arranged thereon.

The upstream side of the first liquid flow path 14 communicates with a first common liquid chamber 15 for supplying plural first liquid flow paths with a first liquid, and the upstream side of the second liquid flow path 16 communicates with a second common liquid chamber 17 for supplying plural second liquid flow paths with a second liquid.

A partition wall 30 composed of a material having elasticity, such as a metal, is provided between the first and second liquid flow paths and liquid-tightly divides the first liquid contained in the first liquid flow path from the second liquid contained in the second liquid flow path so as not to mix them with each other.

A portion of the partition wall, situated in a upward projection space from the surface of the heating element (hereinafter referred to as "discharge pressure-generating region"; region A, and a bubble-generating region 11; region B in FIG. 5), is formed as a movable member 31 in the form of a cantilever where the free end is formed on the side of the discharge opening (the downstream side of the liquid flow) with slit 35, and a supporting point 33 is on the side of the common liquid chambers (15, 17). Since the movable member 31 is facing the bubble-generating region 11 (B), it moves so as to open toward the discharge opening side and into the first liquid flow path upon bubbling of the bubbling liquid (in the arrow direction shown in FIG. 5). In FIG. 6, also, the partition wall 30 is arranged over element substrate 1 intervening a space constituting the second liquid flow path, where the element substrate is provided on it with a heating resistor as the heating element 2 and a wiring electrode 5 for applying an electric signal to the heating resistor. To prevent the mixing of the two liquids at the slit at the free end of the movable member, the slit width may be made such that a meniscus is formed between two liquids as described below. In the present invention, however, this can be achieved by the properties of the first and second liquids. The liquid mixing at the both sides of the movable member may be prevented by taking such a construction that the width of the second liquid flow path corresponding to the movable member is made narrower than the width of the movable member. In the present invention, however, this is also achieved by the properties of the first and second liquids.

The arrangement relationship between the arrangement of the supporting point 33 and free end 32 of the movable member 31, and the heating element 2 is the same as previously described with reference to FIGS. 1A to 1D etc.

The arrangement relationship between the liquid flow path 12 and the heating element 2 has been described above. In this embodiment, also, the arrangement relationship between the second liquid flow path 16 and the heating element 2 is the same.

The operation of the liquid-discharge head according to this embodiment will now be described with reference to FIGS. 7A and 7B. Upon driving the head, a first liquid to be supplied to first liquid flow path 14 and a second liquid as a bubbling liquid to be supplied to second liquid flow path 16 are used. Heat generated by the heating element 2 acts on the bubbling liquid within the bubble-generating region of the second liquid flow path, thereby a bubble is generated in the bubbling liquid on the film boiling phenomenon as described in U.S. Pat. No. 4,723,129.

In this embodiment, the bubbling pressure cannot escape in three directions other than the upstream direction of the bubble generating region, so that the pressure generated with this bubbling is propagated to the movable member 31 intensively. Thus the movable member 31 is displaced from a state illustrated in FIG. 7A toward the region of the first liquid flow path as illustrated in FIG. 7B as the bubble grows. By this operation of the movable member, the first liquid flow path 14 is widely communicated with the second liquid flow path 16, so that the pressure of bubbling is mainly propagated in the direction of the discharge opening (in the direction of A) of the first liquid flow path. The first liquid is discharged from the discharge opening by this pressure propagation and the above-described mechanical displacement of the movable member.

At this time, a portion of the first liquid, which is situated on the discharge opening side within the first liquid flow path 14 to be discharged from the discharge opening, and a portion of the second liquid which is transferred on the side of the first liquid flow path 14 from the second liquid flow path 16, are not mixed with each other, but both discharged as one droplet from the discharge opening.

The combination of the first liquid and the second liquid may be suitably selected from among combinations of liquids having properties not mixed with each other according to the desired purpose, for example, combinations where one of the first liquid and the second liquid is hydrophobic, and the other is hydrophilic.

Specific examples of the combination of these liquids may include the following combinations:

(1) a combination that a water-based ink is used as the first liquid, and a non-polar solvent (for example, cyclohexane or xylene), or a mixture of a water repellent (silicone oil or the like) and a non-polar solvent is used as the second liquid;

(2) a combination that an oil-based ink is used as the first liquid, and an aqueous liquid is used as the second liquid.

As the aqueous liquid, water, or a mixture of water and a water-soluble organic solvent may be used.

As the water-soluble organic solvent, for example, those used in the preparation of ordinary inks for ink-jet recording may be suitable used. Specific examples thereof include amides such as dimethylformamide and dimethylacetamide; ketones such as acetone; ethers such as tetrahydrofuran and dioxane; polyalkylene glycols such as polyethylene glycol and polypropylene glycol; alkylene glycols such as ethylene glycol, propylene glycol, butylene glycol, triethylene glycol, thiodiglycol, hexylene glycol and diethylene glycol; lower alkyl ethers of polyhydric alcohols, such as ethylene glycol monomethyl ether, diethylene glycol monomethyl ether and triethylene glycol monomethyl ether; monohydric alcohols such as ethanol and isopropyl alcohol; 1,2,6-hexanetriol; glycerol; N-methyl-2-pyrrolidone; 1,3-dimethyl-2-imidazolidinone; triethanolamine; sulfolane; dimethyl sulfoxide; and cyclohexanol. These solvents may be used singly or in any combination thereof. The content of the water-soluble organic solvents in the liquid may be suitably selected according to properties and the like required of the liquid. They may be incorporated in an amount of, for example, from 1 to 80% by weight.

The aqueous liquid may contain various additives such as a surfactant, pH adjustor, antiseptic, antioxidant, dissolution aid and dispersing agent either singly or in any combination thereof. Of these, the surfactant, which may also function as a surface-tension adjustor, may preferably be used. Examples of the surfactant include anionic surfactants such as fatty acid salts, salts of higher alcohol sulfates, alkylbenzenesulfonates and salts of higher alcohol phosphates; cationic surfactants such as aliphatic amines and quaternary ammonium salts; nonionic surfactants such as ethylene oxide adducts of higher alcohols, ethylene oxide adducts of alkylphenols, ethylene oxide adducts of fatty acids, ethylene oxide adducts of polyhydric alcohol fatty acid esters, ethylene oxide adducts of higher alkylamines, ethyleneoxide adducts of fatty acid amides, eyhylene oxide adducts of polypropylene glycol, polyhydric alcohol fatty acid esters and alkanolamine fatty acid amides; and amphoteric surfactants such as amino type and betaine type amphoteric surfactants.

A water-based ink containing a coloring material can be obtained by dissolving or dispersing a dye, pigment, disperse toner or the like in the above-described aqueous liquid. The amount of the coloring material may be selected according to the desired image density, the reactivity when the coloring material is used as a reactive element, and the like. However, it may be used in an amount of, for example, from 0.1 to 20% by weight. As the coloring material, there may also be used any coloring material which is dispersed in the aqueous liquid using a water-soluble resin or the like.

The physical properties, for example, viscosity and surface tension, of the aqueous liquid or the water-based ink can be adjusted by selecting its composition.

As for the oil-based ink, no particular limitation is imposed so far as it is an ink used in various printing methods, such as that obtained by dissolving, for example, an oil-soluble dye in an oil-soluble solvent such as xylene or cellosolve, and having properties necessary for the first liquid.

Figure 7A:
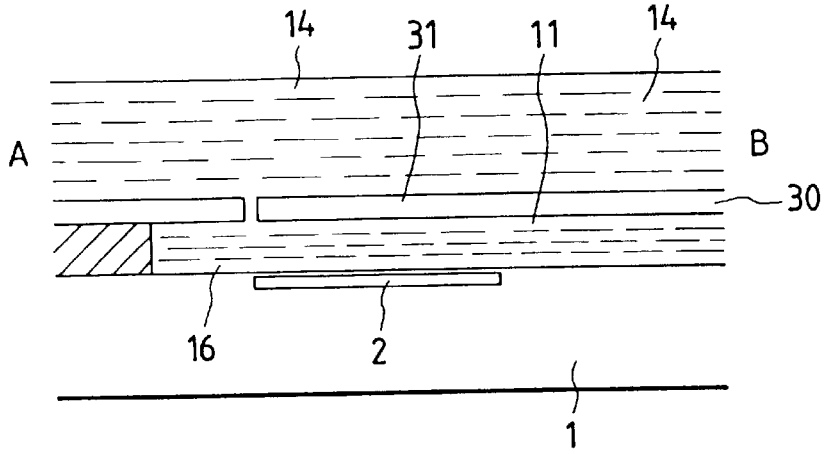
FIGS. 7A and 7B illustrate the operation of the movable member.

Then, the movable member returns to the position illustrated in FIG. 7A as the bubble deflates, and in the first liquid flow path 14, the discharge liquid in an amount corresponding to the amount of the discharged liquid is supplied from the upstream side. In this embodiment, also, the supply of the discharge liquid is conducted toward the closing direction of the movable member as in the above-described embodiment, so that refilling of the discharge liquid is not obstructed by the movable member.

The principal actions and effects concerning the propagating direction of the pressure upon bubbling and the growing direction of the bubble accompanying the displacement of the movable member, and the prevention of back wave are the same as described above with respect to FIGS. 1A to 1D etc. However, this embodiment using the structure of two flow paths has the following merits further.

Namely, thermal properties necessary for bubbling is not required of the first liquid, so that design conditions for the first liquid can be greatly loosened, since different liquids are used as the first liquid and second liquid, and a droplet of these liquids in a state not mixed with each other is discharged by the pressure generated by the bubbling of the second liquid. Even, for example, a high-viscosity liquid, which is hard to be sufficiently bubbled by application of heat and has insufficient discharging ability, can be successfully discharged by supplying this liquid to the first liquid flow path and supplying, as the second liquid, a liquid easy to bubble [for example, a liquid based on a 4:6 mixture of ethanol and water(viscosity: about 1 to 2 cP)] or a low-boiling liquid to the second liquid flow path.

Further, as the second liquid, it may be selected a liquid which does not cause deposit such as scorch on the surface of the heating element even when subjected to high heat, thereby permitting stabilized bubbling and good discharge.

Further, since the above-described effects can also be brought about in the head structure according to the present invention, a liquid such as a high-viscosity liquid can be discharged with still higher discharge efficiency and discharging force.

Further, even a liquid easily affected by heat can be discharged with high discharge efficiency and discharging force as described above without thermally deteriorating this liquid only by supplying this liquid to the first liquid flow path and supplying a liquid which is heat resistant and easy to bubble to the second liquid flow path.

The examples of the principal parts of the liquid-discharge head and liquid-discharging method according to the present invention have been described above. The constructional examples preferably applicable to these examples will hereinafter be described with reference to the drawings.

Figure 8:
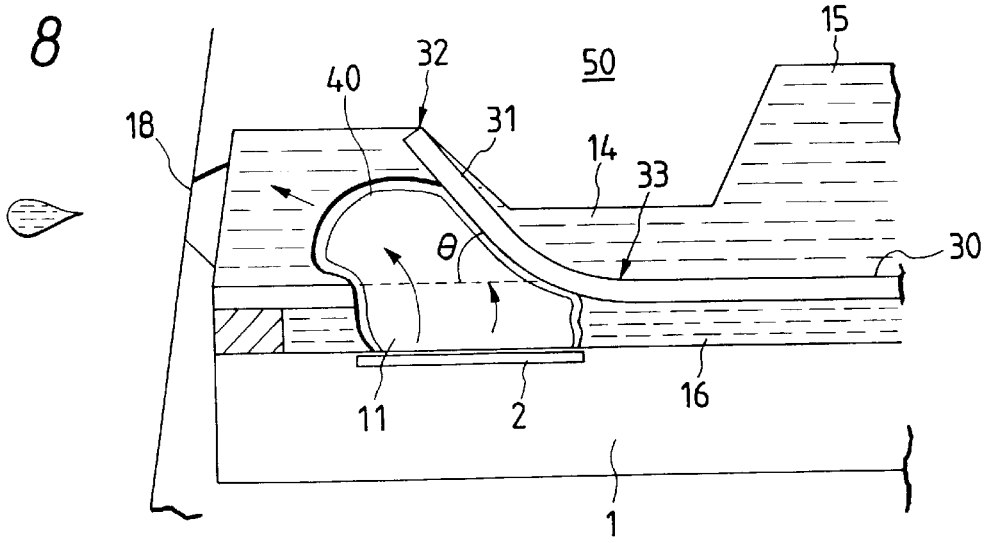
FIG. 8 illustrates the structures of the movable member and the first liquid flow path.

FIG. 8 is a cross-sectional view, taken along the direction of a flow path, of a liquid-discharge head according to an embodiment of the present invention. A grooved member 50 provided with a groove for defining the first liquid flow path 14 (or the liquid flow path 10 in FIGS. 1A to 1D) is provided on a partition wall 30. In this embodiment, the top of the liquid flow path in the vicinity of a free end 32 of a movable member is raised, so that the operation angle θ of the movable member can be made wider. The operation range of the movable member may be determined in view of the structure of the liquid flow path, the durability of the movable member, bubbling ability and the like. However, it is desirable for the movable member to move to an angle including an angle of the discharge opening in the axial direction.

The displacement height of the movable member is made higher than the diameter of the discharge opening as illustrated in FIG. 8, whereby more sufficient transmission of discharging force can be achieved. Further, since the height of the top of the liquid flow path at a position corresponding to a supporting point 33 of the movable member is lower than that of the top of the liquid flow path at a position corresponding to the free end 32 of the movable member as illustrated in FIG. 8, escape of the pressure wave on the upstream side by the displacement of the movable member can be more effectively prevented.

Figure 9A:
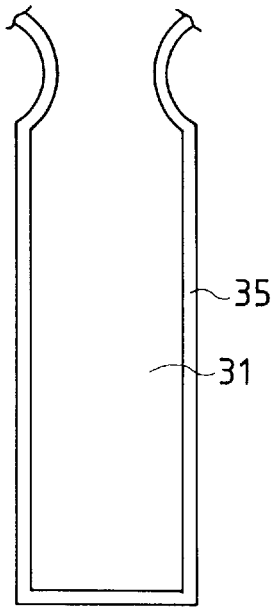
FIGS. 9A, 9B and 9C illustrate the structures of the movable member and the second liquid flow path.
Figure 9B:
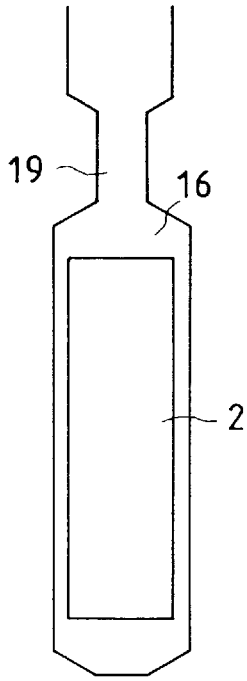
Figure 9C:
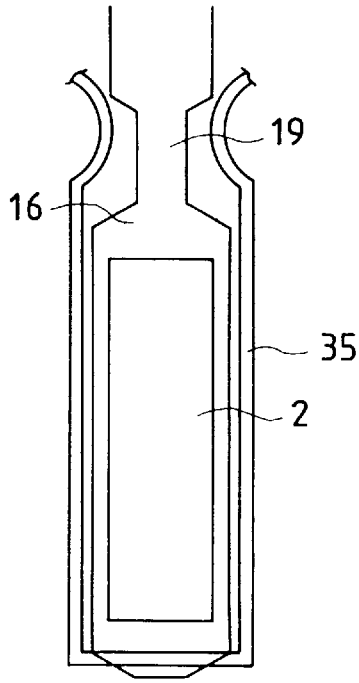

FIGS. 9A to 9C illustrate modification of the arrangement relationship between the second liquid flow path 16 and the movable member 31. FIG. 9A is a top plan view of the vicinity of the movable member 31, FIG. 9B is a top plan view of the second liquid flow path 16 with the movable member 31 removed, and FIG. 9C schematically illustrates an arrangement relationship between the movable member 31 and the second liquid flow path 16 by superimposing the former on the latter. In all of these drawings, the bottom of each drawing is a front side at which the discharge opening is arranged.

The second liquid flow path 16 of this embodiment has a bottleneck part 19 on the upstream side of the heating element 2 (here, the upstream side means the upstream side in a large stream of the second liquid which flows from the second common liquid chamber to the discharge opening via the position of the heating element, the movable member 31 and the first liquid flow path) to form such a chamber (bubbling chamber) as the pressure upon bubbling is prevented from easily escaping to the upstream side of the second liquid flow path 16.

In a conventional head in which a flow path for conducting bubbling and a flow path for discharging a liquid are the same, and a bottleneck part is provided on the common liquid chamber side so as to prevent the pressure generated into the liquid chamber from escaping to the common liquid chamber, it is necessary to adopt the construction that the sectional area of the flow passage at the bottleneck part is not too small taking the refilling of the liquid into full consideration.

In the present embodiment, however, most of the liquid to be discharged is supplied as the first liquid to the first liquid flow path, so that the consumption of the second liquid (bubbling liquid) within the second liquid flow path where the heating element is provided, is greatly reduced compared with the first liquid, and the filling amount of the bubbling liquid into the bubble-generating region in the second liquid flow path may be saved. Accordingly, the space of the bottleneck part 19 can be made as narrow as from several microns to several tens microns, so that the pressure generated upon the bubbling in the second liquid flow path can be further prevented from escaping to surroundings and hence can be intensively guided toward the movable element, and this pressure can be utilized as discharging force through the movable member 31, for higher discharge efficiency. However, the form of the second liquid flow path 16 is not limited to the above-described structure, and any form may be used so far as it is a form that the pressure upon the bubbling can be effectively transmitted on the movable member side.

As illustrated in FIG. 9C, the both edges of the movable member 31 cover part of the wall constituting the second liquid flow path, thereby preventing the movable member 31 from falling in the second liquid flow path. This can ensure that the first liquid in the first liquid flow path is separated from the second liquid in the second liquid flow path when discharge is not conducted. According to this construction, the escape of the bubble through a slit can be prevented, so that discharge pressure and discharge efficiency can be further enhanced. Further, it can enhance the effect of refilling from the upstream side based on the negative pressure generated upon the vanishment of the bubble as described above.

Figure 7B:
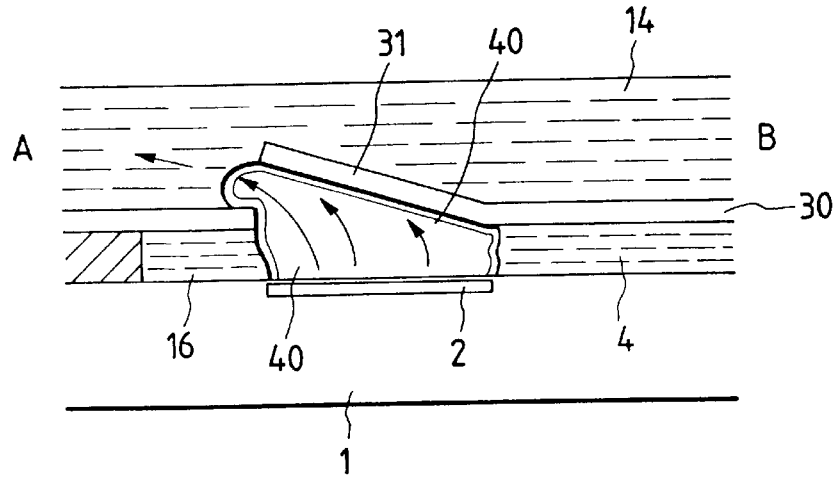

In FIG. 7B and FIG. 8, a part of the bubble generated in the bubble-generating region of the second liquid flow path 4 extends into the first liquid flow path 14 as the movable member 31 is displaced toward the first liquid flow path 14. When the height of the second liquid flow path is made such a height that the bubble can extend into the first liquid flow path, the discharging force can be further increased compared with the case where the bubble can not extend. In order for the bubble to extend to the first liquid flow path 14, it is desired that the height of the second liquid flow path be made lower than the height of the largest bubble, within a range of from several microns to 30 microns. In this embodiment, this height is 15 $\mu$m.

Figure 10A:
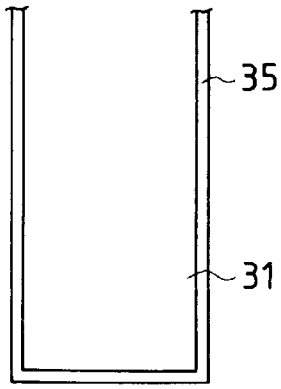
FIGS. 10A, 10B and 10C illustrate other forms of the movable member.
Figure 10B:
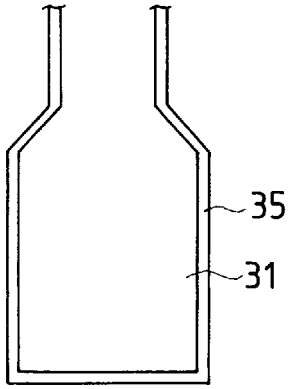
Figure 10C:
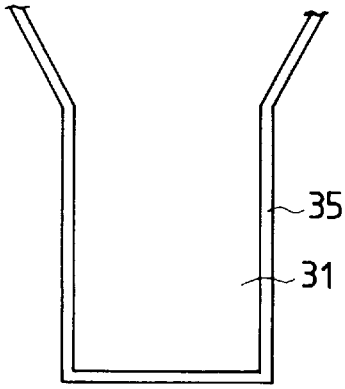

FIGS. 10A to 10C illustrate other forms of the movable member 31. Reference numeral 35 denotes a slit provided in the partition wall. This slit defines the movable member. FIG. 10A illustrates a rectangular form, FIG. 10B illustrates a form having a neck on the supporting point side for easy operation of the movable member, and FIG. 10C illustrates a form having a wider part on the supporting point side to improve its durability. For the easy operation and good durability, a form having a neck defined by two arcs on the supporting point side as illustrated in FIG. 9A is desired. However, any form of the movable member is usable as long as the movable member does not fall in the second liquid flow path, is easy of operation and excellent in durability.

In the preceding embodiment, the plate-like movable member 31 and the partition wall 5 having this movable member are made of a nickel plate having a thickness of 5 $\mu$m, however, the invention is not limited thereto. The material for the movable member and partition wall may be any material so far as it has high solvent resistance to liquids with which they come into contact, and necessary elasticity for successful operation of the movable member, and a slit can be formed therein.

Preferable examples of the material for the movable member include, from the viewpoint of high durability, metals such as silver, nickel, gold, iron, titanium, aluminum, platinum, tantalum, stainless steel and phosphor bronze, and alloys thereof, resins having a nitrile group including acrylonitrile, butadiene, styrene and the like, resins having an amide group such as polyamide, resins having a carboxyl group such as polycarbonate, resins having an aldehyde group such as polyacetal, resins having a sulfone group such as polysulfone, and resin such as liquid crystal polymers, and compounds thereof. From the viewpoint of high resistance to inks, there included are metals such as gold, tungsten, tantalum, nickel, stainless steel and titanium, alloys thereof, and those coated with these metals, resins having an amide group such as polyamide, resins having an aldehyde group such as polyacetal, resins having a ketone group such as poly(ether ether ketone), resins having an imide group such as polyimide, resins having a hydroxyl group such as phenol resins, resins having an ethyl group such as polyethylene, resins having an alkyl group such as polypropylene, resins having an epoxy group such as epoxy resins, resins having an amino group such as melamine resins, resins having a methylol group such as xylene resins, and compounds thereof, and ceramics such as silicon dioxide and compounds thereof.

Preferable examples of the material for the partition wall include resins having good heat resistance, solvent resistance and moldability, typified by engineering plastics in recent years, such as polyethylene, polypropylene, polyamide, polyethylene terephthalate, melamine resins, phenol resins, epoxy resins, polybutadiene, polyurethane, poly(ether ether ketone), poly(ether sulfone), polyarylates, polyimide, polysulfone and liquid crystal polymers (LCP), and compounds thereof, silicon dioxide, silicon nitride, metals and alloys such as nickel, gold and stainless steel and compounds thereof, and those coated with titanium or gold.

The thickness of the partition wall may be determined, considering its material and the shape to achieve high strength as the partition wall, and good operation as the movable member. However, it is desirably within a range of from about 5 to about 10 In this embodiment, the width of the slit 35 defining the movable member 31 was 2 μm. However, the width may be suitably changed so long as the effect by the provision of the movable member is not spoiled. For example, the width is desirably controlled to preferably 5 μm or less, more preferably 3 μm or less. In the present invention, separation between the first liquid and the second liquid supplied respectively to the first liquid flow path and second liquid flow path divided by the movable member and partition wall is ensured by selecting these liquids with their properties. The slit width may be adjusted so that a meniscus is formed with these liquid, whereby more reliable separation can be ensured.

In the present invention, it is intended a movable members having a thickness (t μm) of μm order, not those having a thickness of cm order. When a slit width (W μm) of μm order is intended for the movable member having a thickness of Am order, it is desirable to consider the production variation to some extent.

When the thickness of a wall member facing the free end and/or the edges of the movable member, around which the slit is formed, is equal to that of the movable member (FIGS. 7A and 7B, and FIG. 8), mixing of two liquids in a stationary state (no discharging operation) can be more stably prevented by adjusting the relationship between the slit width and the thickness of the movable member within the following range taking the production variation into consideration. Mixing of two liquids can be prevented over a long period of time by satisfying the relationship of $W/t \leqq 1$ when a high-viscosity ink (5 cP, 10 cP, etc.) is used with a second liquid having a viscosity of 3 cP or lower, as a limiting condition for the construction of the head.

As a slit which imparts "a substantially closed state" of the present invention by only the structure of a head, a slit of the order of several microns can ensure such a state. However, this condition can be loosened by utilizing a difference in liquid properties according to the present invention.

As described above, the movable member also functions as a part of the partition member between the first liquid and the second liquid. When this movable member is displaced as the bubble is generated, a part of the second liquid in the second liquid flow path enters the first liquid flow path, thereby forming a discharge droplet composed of the first liquid and the second liquid in a state not mixed with each other. The proportions of these liquids in a discharge droplet, which participates in image formation, may be suitably selected according to the construction of the head and the like. In order to effectively exhibit such a merit that thermal requirements necessary for bubbling can be greatly lightened, however, it is preferable that the proportion of the first liquid be as high as possible within limits permitting the achievement of the objects of the present invention. It is preferable to preset in such a manner that the occupied ratio of the first liquid to the second liquid is within a range of, for example, from 50:50 to 95:5. It is preferable to preset the density of a coloring material from the occupied ratio of the first liquid to the second liquid.

The occupied ratio of the first liquid to the second liquid can also be controlled, for example, by changing drive conditions of the heating element arranged in the bubble-generating region. This controlling method is described referring to the case where the first liquid of an aqueous liquid is mixed with the second liquid to be discharged. This method may also be applied to a method of the present invention where two liquids are made coexist in discharge, preferably, for example, to express tone gradation.

The arrangement relationship between the heating element and the movable member in this head will now be described with reference to the drawings. However, the forms, dimensions and numbers of the movable members and heating elements are not limited to the following. The pressure upon bubbling by the heating element can be effectively utilized as a discharge pressure by the optimum arrangement of the heating element and the movable member.

Figure 11:
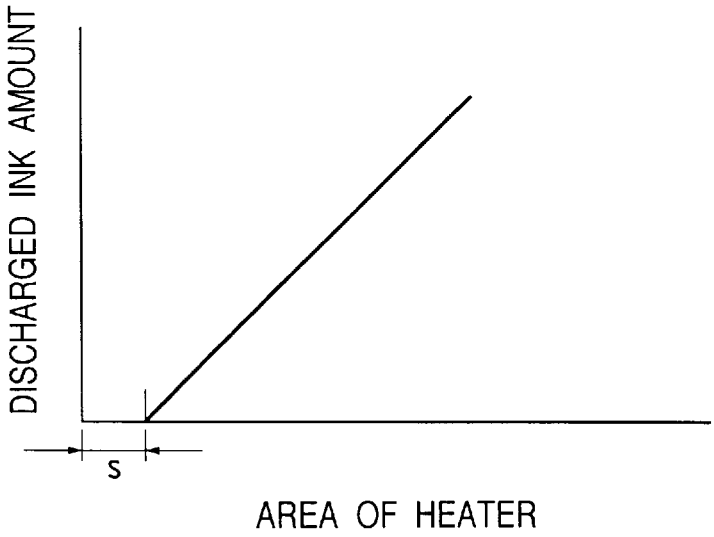
FIG. 11 diagrammatically illustrates a relationship between the area of a heating element and the amount of discharged ink.

In the prior art of the ink-discharge recording method, so-called bubble-jet recording method, in which the application of energy such as heat to ink causes a change of state accompanied by the rapid volumetric change (generation of bubbles) in the ink, and the ink is discharged out from the discharge opening by the working force generated from this state change, and applied to a recording medium, thereby forming an image, as illustrated in FIG. 11, there is a proportional relationship between the area of the heating element and the discharge quantity of the ink. However, it has been found that there is an ineffective region S for bubbling which does not contribute to the discharge of the ink. It has also been found from the condition of scorch on the heating element that the ineffective region S for bubbling exists on the periphery of the heating element. From these results, it is said that the peripheral portion of the heating element by about 4 μm in width does not participate in the bubbling.

Accordingly, one can say that in order to effectively utilize the pressure generated upon the bubbling, it is effective to arrange the movable member in such a manner that the movable region covers a space right over the effective area for bubbling of the heating element, which is a region inside by at least about 4 μm from the periphery. In the present invention, the effective area for bubbling is defined as being an region inside by at least about 4 μm from the periphery, to which, however, the invention is not limited, depending on the kind and forming method of the heating element.

Figure 12A:
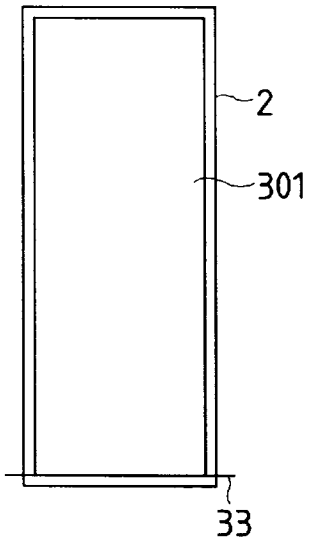
FIGS. 12A and 12B illustrate an arrangement relationship between a movable member and a heating element.
Figure 12B:
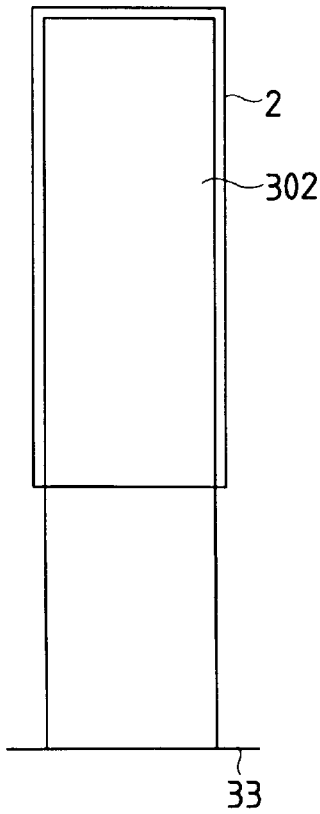

FIGS. 12A and 12B are schematic top plan views of heating elements of 58×150 μm and movable members 301 (FIG. 12A) and 302 (FIG. 12B) arranged over them. 301 and 302 are different in the area of the moving region from each other.

The movable member 301 is 53×145 μm in dimensions and is smaller than the area of the heating element 2, but is substantially equal in dimensions to the effective area for bubbling of the heating element 2. The movable member 301 is arranged so as to cover the effective area for bubbling.

On the other hand, the movable member 302 is 53×220 μm in dimensions and is larger than the area of the heating element 2 (the same width, the length from a supporting point to a movable end is longer than that of the heating element). The movable member 302 is also arranged so as to cover the effective area for bubbling. The movable members 301 and 302 were tested as to durability and discharge efficiency. As a result, with respect to the durability of the movable members, the supporting point portion of the movable member 301 was damaged when $1\times10^7$ pulses were applied. On the other hand, the supporting point portion of the movable member 302 was not damaged even when $3\times10^8$ pulses were applied. In addition, it was recognized that kinetic energy calculated from the discharge quantity and discharge rate in relation to the energy applied was also improved by about 1.5 to 2.5 times with the movable element 302.

From the above results, one can understood that it is better that the movable member is arranged so as to cover the area right over the effective area for bubbling, and the area of the movable member is larger than that of the heating element from the viewpoint of both durability and discharge efficiency.

Figure 13:
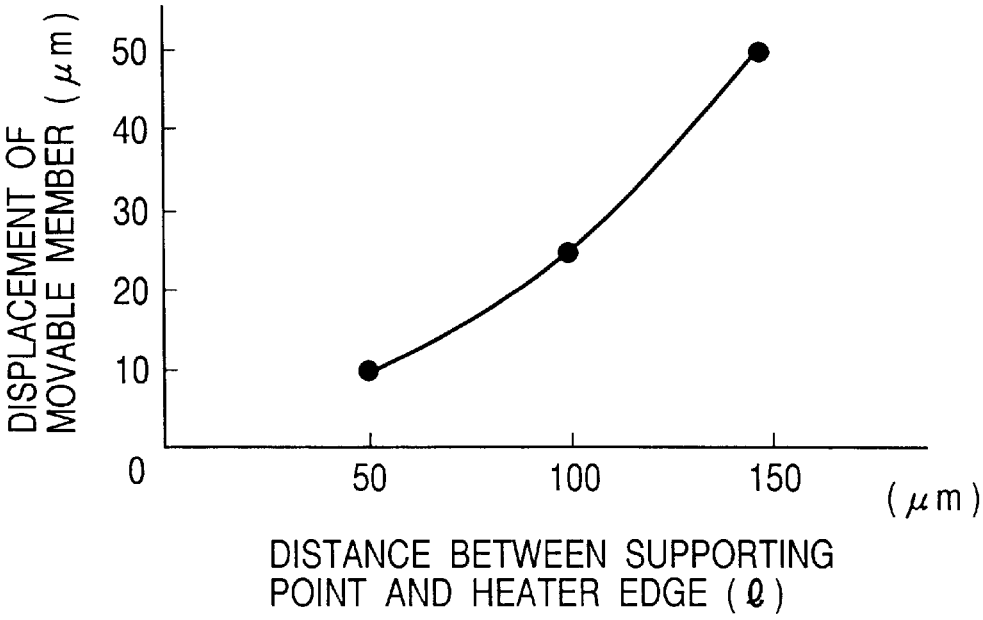
FIG. 13 diagrammatically illustrates the relationship between the distance from an edge of a heating element to the supporting point of a movable member, and a displacement of the movable member.
Figure 14:
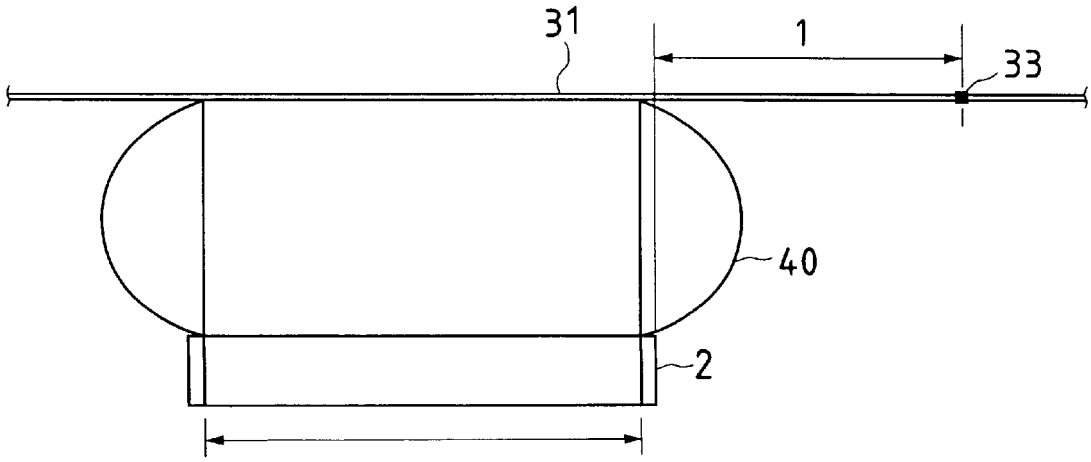
FIG. 14 illustrates an arrangement relationship between a movable member and a heating element.

FIG. 13 diagrammatically illustrates a relationship between the displacement of a movable member and the distance l from the supporting point of a movable member to the edge of a heating element. FIG. 14 is a sectional block diagram illustrating a positional relationship between the movable member 31 and the heating element 2 viewed from the side direction. The heating element used was 40×105 μm in dimensions. One can see that the displacement becomes greater as the distance l from an edge of the heating element 2 to a supporting point of the movable member 31 is longer. Accordingly, it is desirable that the location of the supporting point of the movable member is determined from the optimum displacement determined based on the discharge ink quantity required, flow path structure for the discharge liquid and the form of the heating element.

When the supporting point of the movable member is situated right over the effective area for bubbling of the heating element, the pressure by the bubbling is directly applied to the supporting point in addition to the stress by the displacement of the movable member, so that the durability of the movable member is lowered. The experiments by the present inventors have revealed that in a head in which the supporting point is arranged right over the effective area for bubbling, the moving wall is damaged by application of about $1\times10^6$ pulses, and so its durability is lowered. Therefore, when the supporting point of the movable member is arranged not right over the effective area for bubbling, even a movable member of a form and material not high in durability can be practically used. On the other hand, even when the supporting point is situated right over the effective area for bubbling, such a movable member can be successfully used by selecting its form and material. In such a construction, a liquid-discharge head having high discharge efficiency and excellent durability can be provided.

The construction of an element substrate provided with a heating element for applying heat to a liquid will hereinafter be described.

Figure 15A:
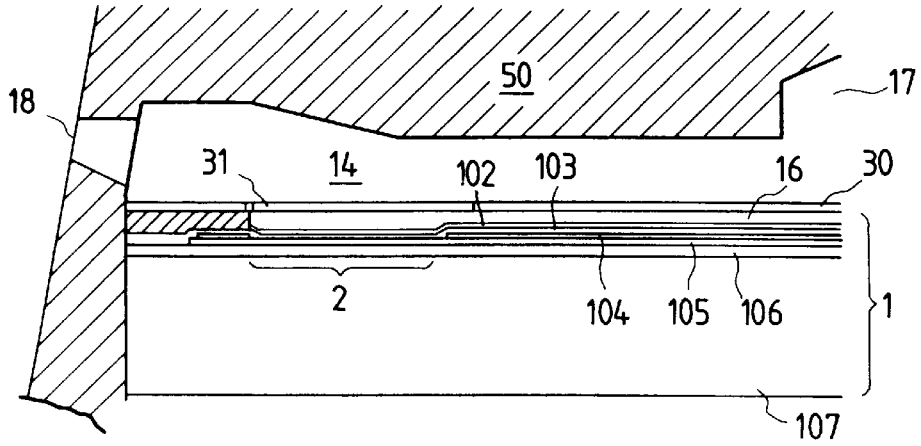
FIGS. 15A and 15B are longitudinal sectional views of liquid-discharge heads according to other embodiments of the present invention.
Figure 15B:
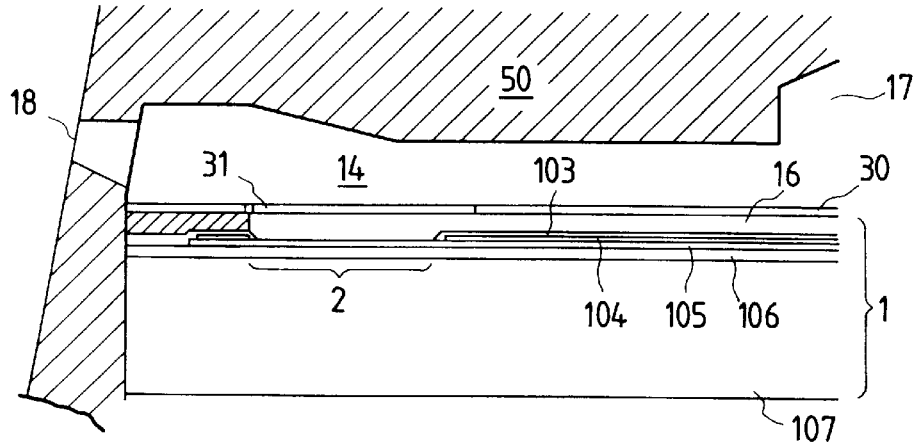

FIGS. 15A and 15B are longitudinal sectional views illustrating liquid-discharge heads, one provided with a protective film which will be described subsequently, and one with no protective film, respectively.

On element substrate 1, a second liquid flow path 16, a partition wall 30, a first liquid flow path 14 and a grooved member 50 provided with a groove for defining the first liquid flow path are arranged in this order.

The element substrate 1 comprises substrate 107 made of silicon etc. on which a film 106 of silicon oxide or silicon nitride for purposes of insulation and heat accumulation, a heating resistor layer 105 (thickness: 0.01 to 0.2 μm) made of hafnium boride ($HfB_2$), tantalum nitride (TaN) or tantalum aluminum (TaAl) constituting a heating element, and wiring electrodes 104 (thickness: 0.2 to 1.0 μm) made of aluminum or the like patterned as illustrated in FIG. 6, in this order from the substrate. Voltage is applied to the resistor layer 105 from the two wiring electrodes 104 to cause a current to flow through the resistor layer, thereby generating heat. On the resistor layer between the wiring electrodes, a protective layer formed of silicon oxide, silicon nitride or the like is formed in a thickness of 0.1 to 2.0 μm, on which a cavitation resistant layer (thickness: 0.1 to 0.6 μm) is further formed with tantalum or the like to protect the resistor layer 105 from various liquids such as inks.

In particular, the pressure and shock wave generated upon bubbling or vanishment of the bubble are very intense, which significantly lower the durability of the oxide film which is hard and brittle. Therefore, tantalum (Ta) or the like, which is a metallic material, is used as the cavitation resistant layer.

The head may have a construction that the above-described protective layer is not required according to the combination of liquids, liquid flow path structures and resistor material. Such a construction is illustrated in FIG. 15B. Examples of a material for such a resistor layer not requiring any protective layer include iridium-tantalum-aluminum alloys and the like.

As described above, the heating elements in the above-described respective embodiments may be constructed either by only the resistor layer (heating part) between the electrodes or by the resistor layer and the protective layer for protecting it.

In this embodiment, the heating element having the heating part composed of a resistor layer, which generates heat in response to electric signals, is used as the heating element, to which, however, the invention is not limited. Any heating element may be used so far as it can cause bubbling in the second liquid as a bubbling liquid, sufficient to discharge a discharge liquid. For example, a heating element having a heating part composed of a photothermal converter which generates heat with light such as laser, or a heating part which generates heat with a high frequency.

In addition to the electrothermal converter composed of the resistor layer 105 constructing the above-described heating part and the wiring electrodes 104 for transmitting electric signals to the resistor layer, a functional element for selectively driving the electrothermal converter, such as a transistor, diode, latch or shift resister, may be integrally fabricated in the above-described element substrate 1 by a semiconductor production process.

Figure 16:
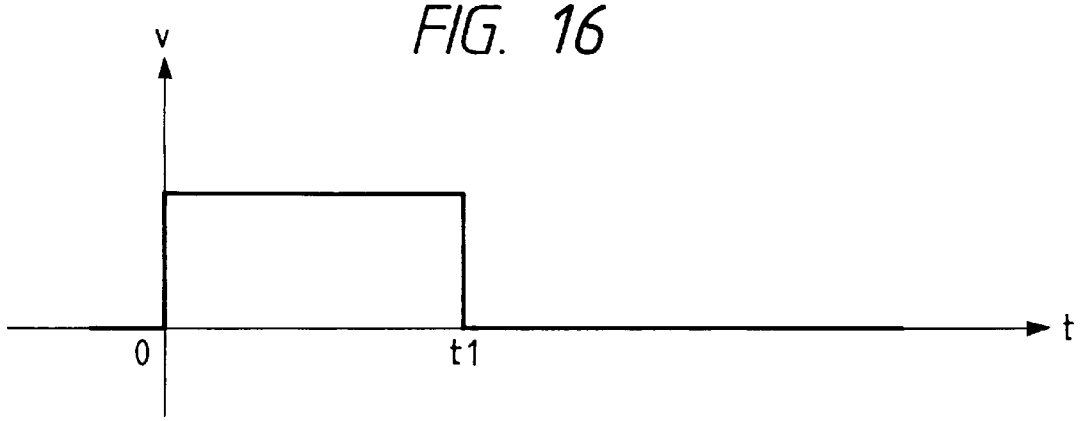
FIG. 16 schematically illustrates the form of a drive pulse.

In order to drive the heating part of the electrothermal converter provided on such an element substrate 1 as described above to discharge a liquid, such a rectangular pulse as illustrated in FIG. 16 is applied to the above-described resistor layer 105 through the wiring electrodes 104 to cause the resistor layer 105 between the wiring electrodes to rapidly generate heat. In each of the heads in the above-described respective embodiments, the heating element was driven by applying an electric signal composed of voltage of 24 V, pulse width of 7 μsec and current of 150 mA in the frequency of 6 kHz to discharge a liquid ink from the discharge opening in accordance with such operation as described above. However, the conditions for the drive signal are not limited to the above, and any drive signal may be used so far as it allows a bubbling liquid to adequately bubble.

An exemplary construction of a liquid-discharge head which can successfully introduce liquids of different kinds into first and second common liquid chambers without mixing, and can reduce the number of parts and production cost will hereinafter be described.

Figure 17:
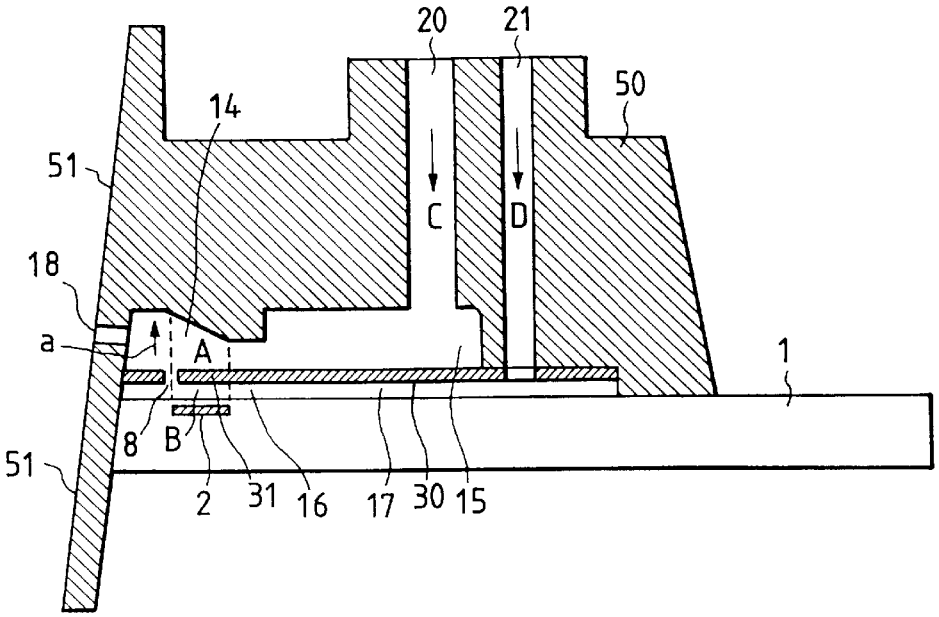
FIG. 17 is a cross-sectional view illustrating exemplary supply or feed paths of a liquid-discharge head according to the present invention.

FIG. 17 is a schematic cross-sectional view illustrating the construction of a liquid-discharge head.

In this embodiment, a grooved member 50 is composed roughly of an orifice plate 51 having discharge openings 18, plural grooves for defining plural first liquid flow paths 14, respectively, and a grooved part for defining a first common liquid chamber 15 which communicates with the plural liquid flow paths 14 and supplies each first liquid flow path 14 with a first liquid.

The plural first liquid flow paths 14 can be defined by bonding a partition wall 30 to a bottom portion of the grooved member 50. Such a grooved member 50 has a first liquid feed path 20 extending from its top to the first common liquid chamber 15. In addition, the grooved member 50 has a second liquid feed path 21 extending from its top to a second common liquid chamber 17 through the partition wall 30.

The first liquid is supplied to the first common liquid chamber 15 and then first liquid flow paths 14 through the first liquid feed path 20 as indicated by the arrow C, while the second liquid is supplied to the second common liquid chamber 17 and then second liquid flow paths 16 through the second liquid feed path 21 as indicated by the arrow D.

In this embodiment, the second liquid feed path 21 is arranged in parallel with the first liquid feed path 20, to which, however, the invention is not limited. It may be arranged in any way so far as it is defined so as to pass through the partition wall 30 provided outside the first common liquid chamber 15 and communicate with the second common liquid chamber 17.

The thickness (diameter) of the second liquid feed path 21 is determined in view of the feed rate of the second liquid. The form of the second liquid feed path 21 need not be in a round shape and may be in a rectangular shape.

Figure 18:
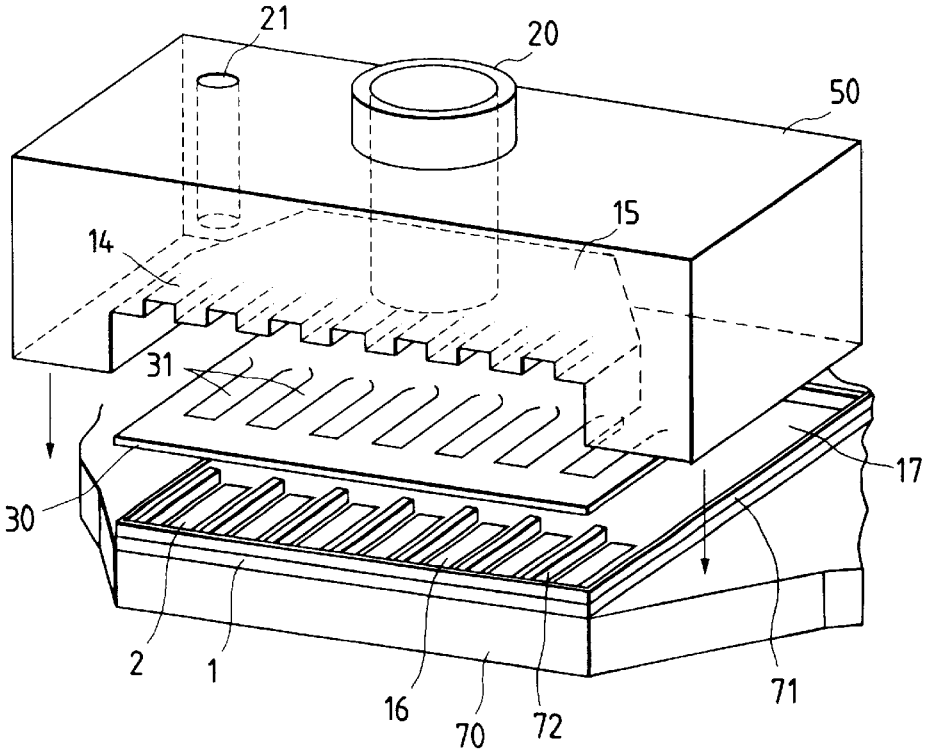
FIG. 18 is an exploded perspective view of an exemplary head according to the present invention.

The second common liquid chamber 17 can be formed by dividing the grooved member 50 with the partition wall 30. As a forming process, as illustrated in an exploded perspective view of this embodiment shown in FIG. 18, a common liquid chamber frame and a second liquid flow path wall are formed by a dry film on the element substrate, and an assembly of the grooved member 50 and the partition wall 30 fixed thereto is bonded to the element substrate 1, whereby the second common liquid chamber 17 and the second liquid flow paths 16 may be formed.

In this embodiment, the element substrate 1, on which a plurality of the electrothermal converters have been provided as heating elements which generate heat for causing bubbling to generate a bubble by film boiling as described above, is arranged on base 70 of a metal such as aluminum.

Arranged on the element substrate 1 are plural grooves for defining the liquid flow paths 16 formed by the second liquid flow path wall, a recessed part for defining the second common liquid chamber (common bubbling liquid chamber) 17 for supplying each bubbling liquid flow path with the liquid for bubbling, and the partition wall 30 provided with the moving walls 31.

Reference numeral 50 denotes the grooved member. The grooved member 50 has grooves for defining discharge-liquid flow paths (first liquid flow paths) 14 by being bonded to the partition wall 30, a recessed part for defining the first common liquid chamber (common discharge-liquid chamber) 15 for supplying each discharge liquid flow path with the discharge liquid, the first feed path (discharge-liquid feed path) 20 for feeding the first liquid to the first common liquid chamber and the second feed path (bubbling liquid feed path) 21 for feeding the second liquid (bubbling liquid) to the second common liquid chamber 17. The second feed path 21 passes through the partition wall 30 provided outside the first common liquid chamber 15 and is connected to a communication path communicating with the second common liquid chamber 17. This communication path allows the second liquid to be fed to the second common liquid chamber 17 without mixing it with the first liquid.

With respect to the arrangement relationship among the element substrate 1, the partition wall 30 and the grooved top plate 50, each movable member 31 is arranged facing the heating element on the element substrate 1, and the liquid flow path 14 is arranged opposite the movable member 31. In this embodiment, an example where one second feed path is arranged in the grooved member has been described. However, a plurality of second feed paths may be provided according to the feed rate of the second liquid. Flow path sectional areas of the first feed path 20 and the bubbling liquid feed path 21 may be determined in proportion to the respective feed rates. Parts for constructing the grooved member 50 and the like may be miniaturized by optimizing such flow path sectional areas.

According to this embodiment, as described above, the second feed path for feeding the second liquid to the second liquid flow path and the first feed path for feeding the first liquid to the first liquid flow path are formed into a grooved top plate as the grooved member, whereby the number of parts can be reduced, and shortening of the production process and reduction of production cost become feasible.

In addition, the supply of the second liquid to the second common liquid chamber communicating with the second liquid flow path is conducted through the second feed path in the direction passing through the partition wall which separates the first liquid from the second liquid, so that the steps of bonding the partition wall, the grooved member and the heating element-formed substrate to one another may be conducted at a time. Therefore, easiness of production can be improved, and moreover the accuracy of bonding can be enhanced, whereby the discharge liquid can be smoothly discharged.

Further, since the second liquid is fed to the second common liquid chamber passing through the partition wall, the second liquid can be reliably supplied to the second liquid flow path, and sufficient feed rate can be ensured, whereby stable discharge becomes feasible.

In the present invention, as described above in the preceding embodiment, the construction having the above-described movable members permits discharging a liquid under higher discharging force and at a higher speed than the conventional liquid-discharge head.

A liquid-discharge head cartridge on which the liquid-discharge head according to the above-described embodiment has been mounted will now be roughly described.

Figure 19:
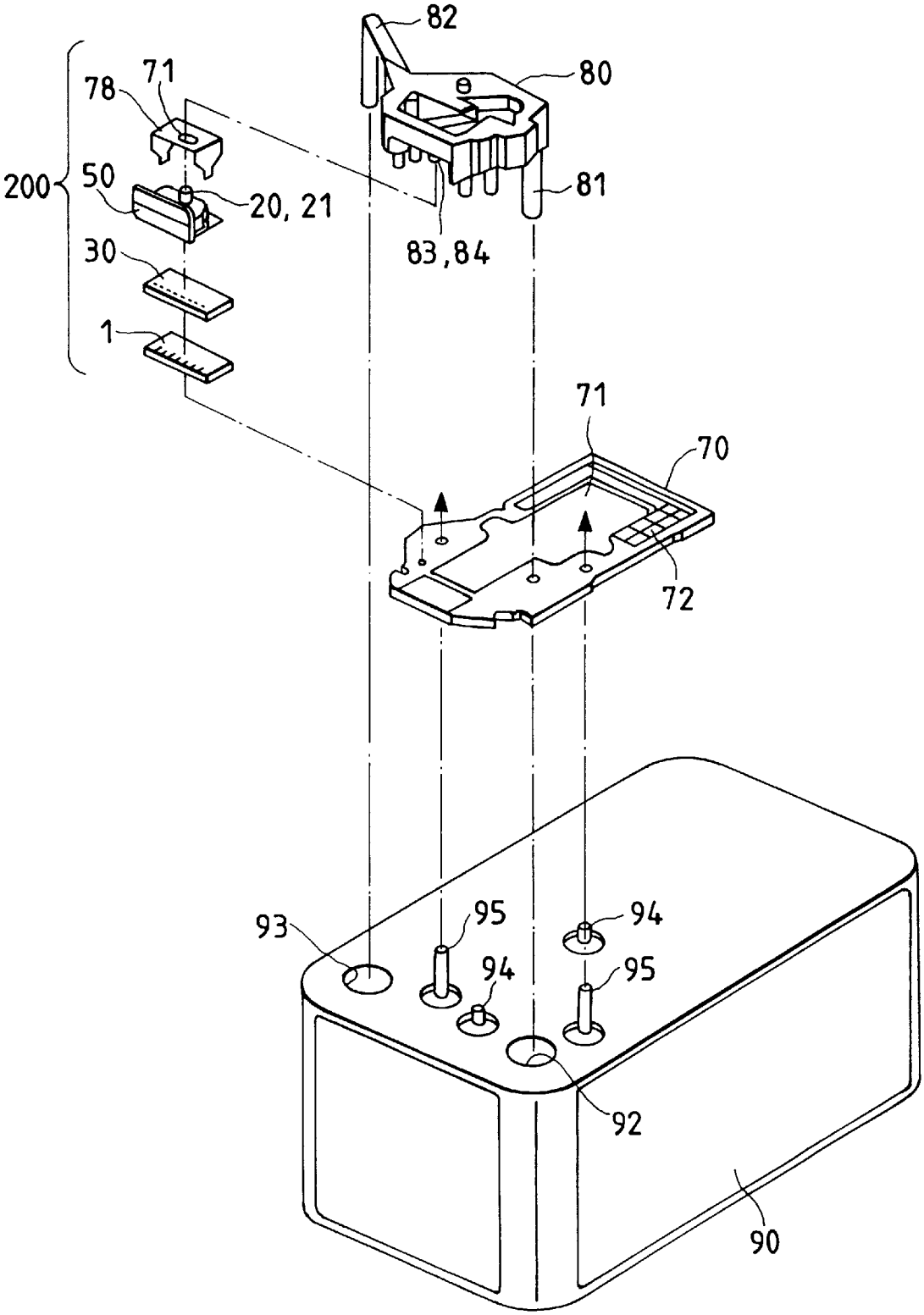
FIG. 19 is an exploded perspective view of a liquid-discharge head cartridge.

FIG. 19 is a schematic exploded perspective view of a liquid-discharge head cartridge comprising the above-described liquid-discharge head. The liquid-discharge head cartridge mainly comprises a liquid-discharge head part 200 and a liquid container 90.

The liquid-discharge head part 200 is composed of an element substrate 1, a partition wall 30, a grooved member 50, a presser bar spring 78, a liquid feed member 80, a base 70 and the like. Provided on the element substrate 1 are a plurality of heating resistors for applying heat to a bubbling liquid in rows as described above, and a plurality of functional elements for selectively driving the heating resistors. Bubbling liquid flow paths are defined between the element substrate 1 and the above-described partition wall 30 having moving walls, through which the bubbling liquid flows. Discharge-liquid flow paths (not illustrated), through which a discharge liquid flows, are defined by bonding the partition wall 30 to the grooved top plate 50.

The presser bar spring 78 is a member for applying biasing force in the direction of the element substrate 1 to the grooved member 50. The element substrate 1, the partition wall 30 and the grooved member 50 are successfully united to a base 70, which will be described subsequently, by this biasing force.

The base 70 is used to support the element substrate 1 and the like. Further arranged on the base 70 are a circuit board 71 connected to the element substrate 1 to feed electric signals, and contact pads connected to an apparatus to give and receive electric signals to and from the apparatus.

The liquid container 90 separately contains two liquids to be fed to the liquid-discharge head. Provided outside the liquid container 90 are positioning parts 94 for installing a joint member for joining the container to the liquid-discharge head and fixing shafts 95 for fixing the joint member. The first liquid to be fed to the first liquid flow path is fed from a feed path 92 of the liquid container 90 through a feed path 84 of the joint member to a feed path 81 of the liquid feed member 80, and supplied to the first common liquid chamber through the feed paths 83, 71, 21 of the individual members. The second liquid (bubbling liquid) is also fed from a feed path 93 of the liquid container 90 through a feed path of the joint member to a feed path 82 of the liquid feed member 80 and supplied to the second common liquid chamber through the feed paths 84, 71, 22 of the individual members.

The liquid container may be reused by refilling the respective liquids into it after consuming the liquids. It is therefore desirable to provide liquid inlet ports in the liquid container. Further, the liquid-discharge head and the liquid container may be formed either integrally with each other or separately from each other.

Figure 20:
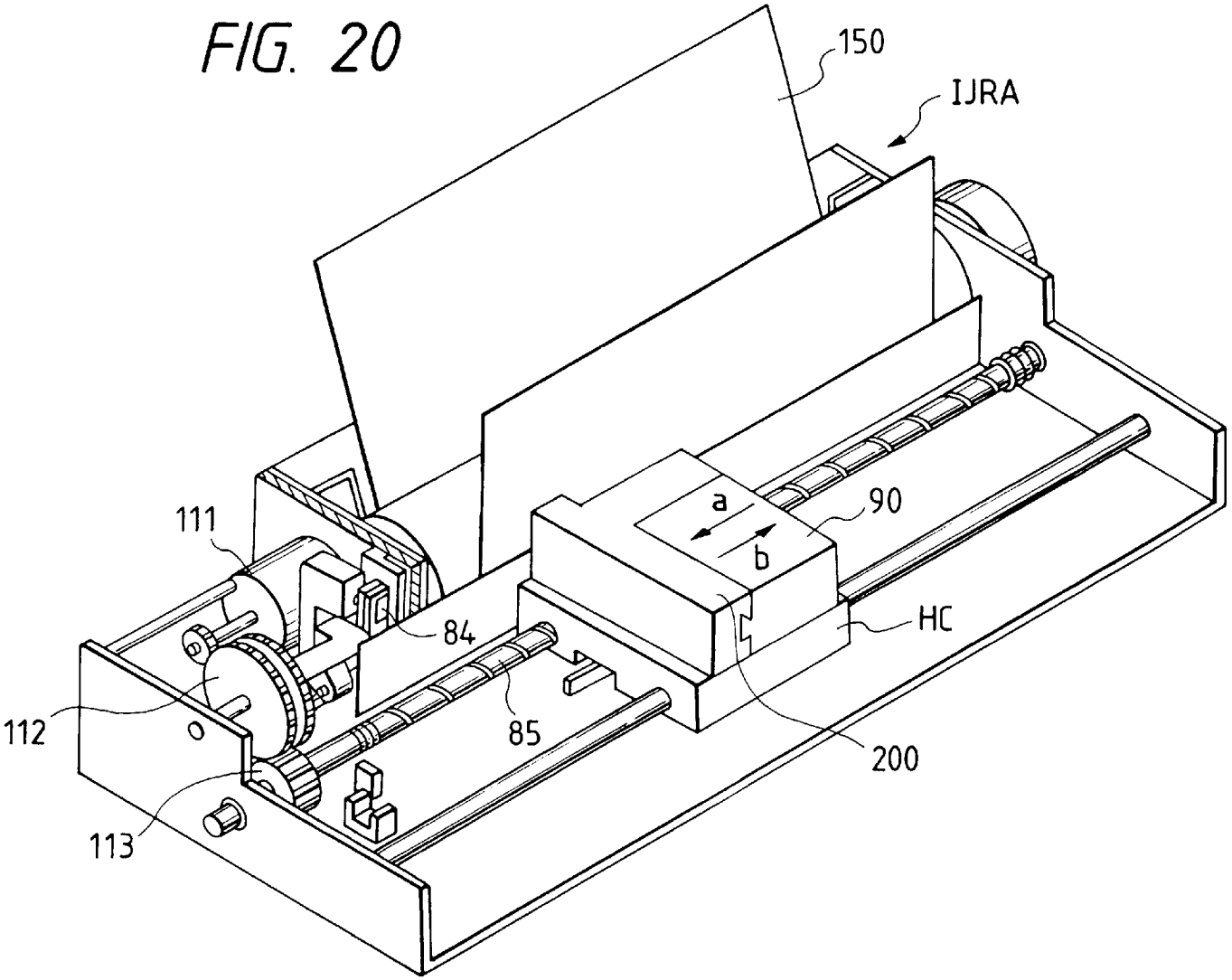
FIG. 20 schematically illustrates the construction of a liquid-discharge apparatus.

FIG. 20 schematically illustrates the construction of a liquid-discharge apparatus in which the above-described liquid-discharge head has been mounted. Carriage HC is mounted with a head cartridge detachably provided with a liquid tank part 90 and a liquid-discharge head part 200 and reciprocally moves in the width direction of recording medium 150 such as recording paper, which is conveyed by a recording medium conveying means.

When a drive signal is applied to the liquid discharging means on the carriage from a drive signal feeding means not illustrated, the first liquid and the second liquid are discharged in a combined state from the liquid-discharge head in response to this signal.

The liquid-discharge apparatus according to this embodiment has a motor 111 as a drive source for driving the recording medium conveying means and carriage, gears 112, 113 and a carriage shaft 115 for transmitting moving power from the drive source to the carriage, and the like. Liquids were discharged on various recording media by this recording apparatus and the ink-discharge method performed by this recording apparatus, whereby prints having good images were successfully provided.

Figure 21:
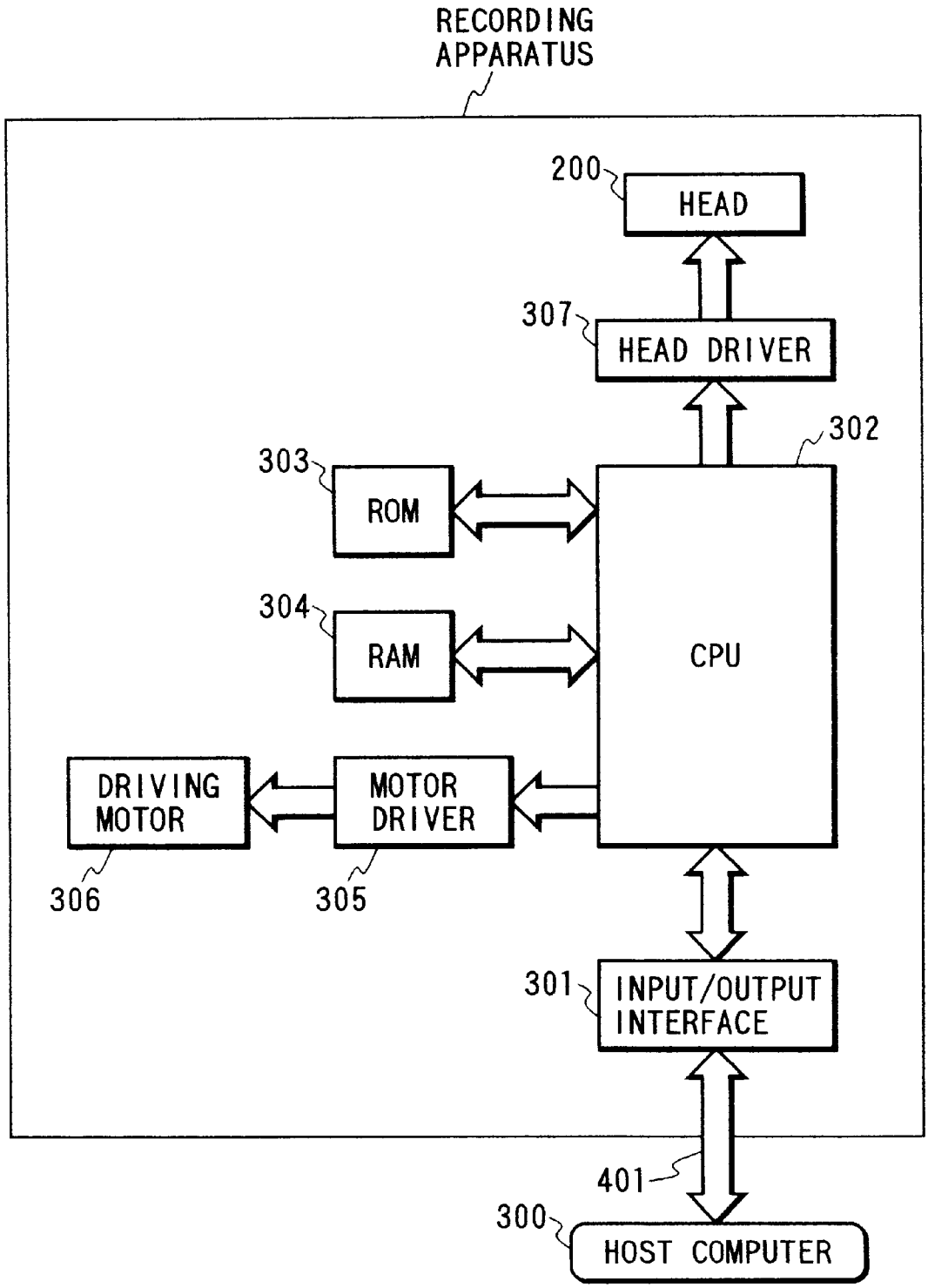
FIG. 21 is a block diagram of the apparatus.

FIG. 21 is a block diagram illustrating the operation of the whole apparatus for conducting ink-discharge recording to which the liquid-discharge method and liquid-discharge head according to the present invention are applied.

The recording apparatus receives printing information as a control signal from a host computer 300. The printing information is temporally stored in an input interface 301 within the printing (recording) apparatus, and at the same time converted into data processable in the recording apparatus to input it into a CPU 302 combined with a means for feeding a head-driving signal. The CPU 302 processes the input data using peripheral units such as a RAM 304 on the basis of the control program stored in a ROM 303 to convert the data into printing data (image data).

In order to print the image data at proper positions on the recording paper, the CPU 302 also creates drive data for driving a drive motor which moves the recording paper and the recording head synchronously with the image data. The image data and motor drive data are transmitted to a head 200 and a drive motor 306, respectively, through a head driver 307 and a motor driver 305 to drive the head and the drive motor at the controlled timing, thereby forming an image.

Examples of recording media which can be applied to such a recording apparatus as described above include various kinds of paper, sheets for OHP, plastic materials used in compact disks and decoration plates, cloth, metallic materials such as aluminum and copper, leather materials such as cowhide, pigskin and artificial leather, wood materials such as wood and plywood, bamboo, ceramic materials such as tile, and three-dimensional structures such as sponge.

The above-described recording apparatus includes printers for conducting recording on various kinds of paper and sheets for OHP, recording apparatus for plastics for conducting recording on plastic materials such as compact disks, recording apparatus for metals for conducting recording on metallic plates or sheets, recording apparatus for leather for conducting recording on leather, recording apparatus for wood for conducting recording on wood, recording apparatus for ceramics for conducting recording on ceramic materials, recording apparatus for conducting recording on three-dimensional structures such as sponge and textile printing apparatus for conducting printing on cloth.

As the discharge liquids used in these liquid-discharge apparatus, there may be used liquids which at least have the features of the present invention and are fitted to the respective recording media and recording conditions.

An exemplary ink-discharge recording system in which the liquid-discharge head according to the present invention is used as a recording head to conduct recording on recording media will now be described.

Figure 22:
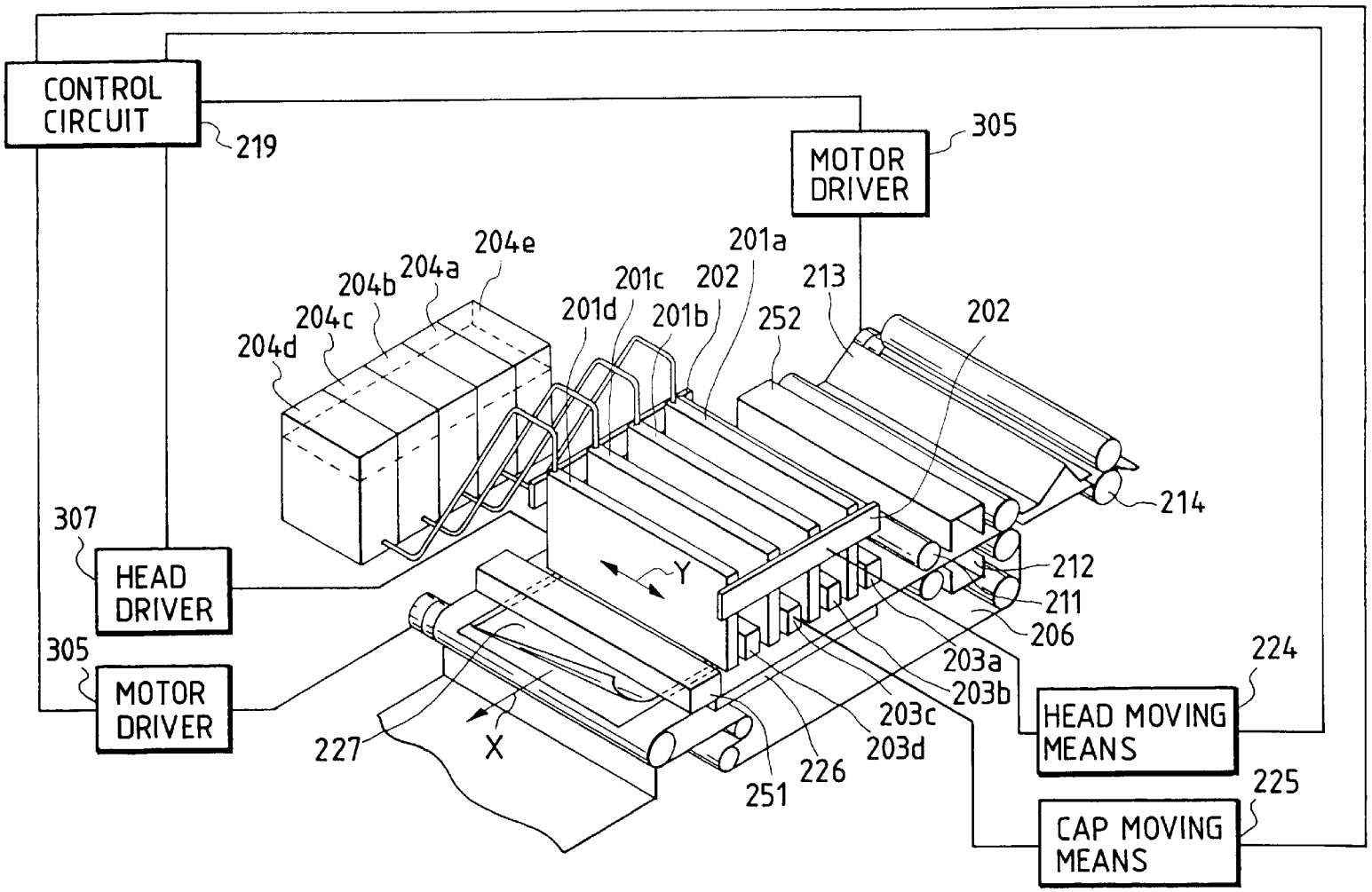
FIG. 22 illustrates a liquid-discharge recording system.
Figure 23A:
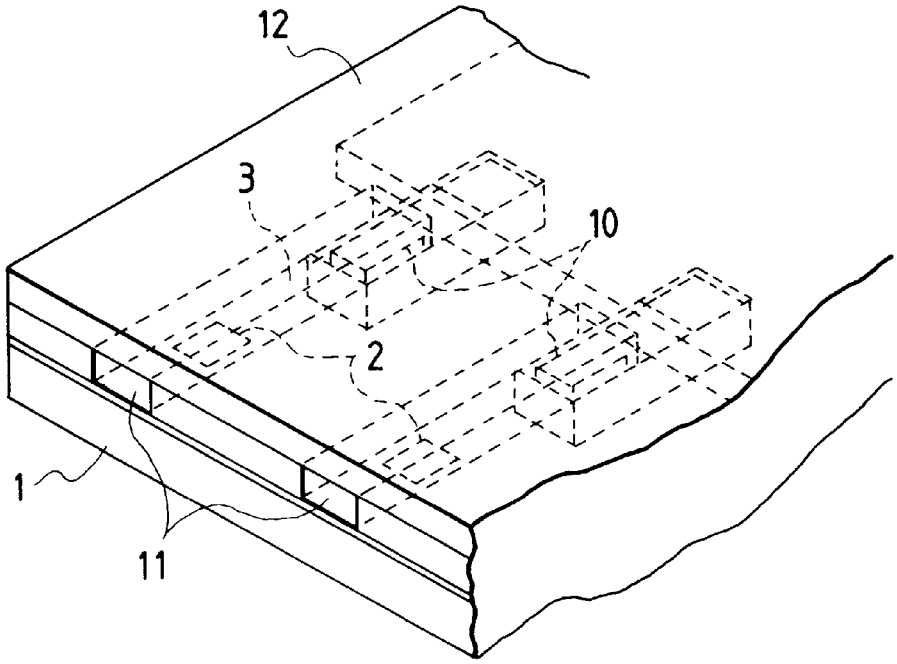
FIG. 23A PRIOR ART
FIGS. 23A and 23B illustrate the structure of a liquid flow path of a conventional liquid-discharge head.
Figure 23B:
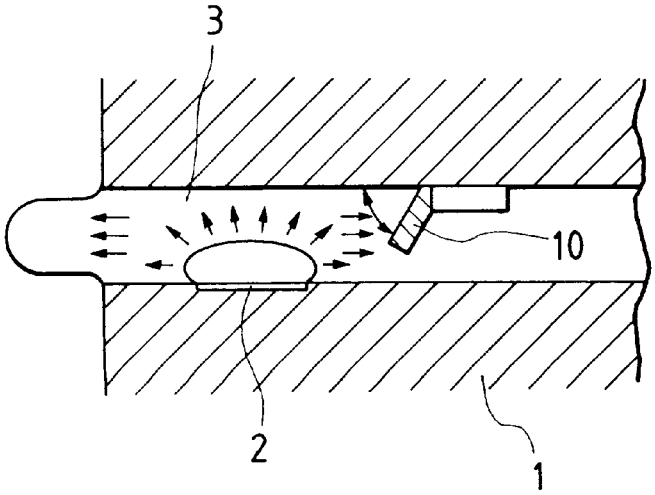
FIG. 23B PRIOR ART

FIG. 22 schematically illustrates the construction of an ink-discharge recording system using liquid-discharge heads 201 according to the present invention. The liquid-discharge heads in this embodiment are full-line type heads each provided with a plurality of discharge openings at intervals of 360 dpi in the length corresponding to the recording width of a recording medium 150. Four heads for 4 colors of yellow (Y), magenta (M), cyan (C) and black (Bk) are fixedly supported by a holder 202 in parallel with one another at the predetermined intervals in the direction of X.

Signals are separately fed to these heads from a head driver 307 constructing a drive signal feeding means to drive the respective heads in response to these signals.

The heads are supplied with four inks of Y, M, C and Bk colors from ink containers 204*a* to 204*d*, respectively. Incidentally, reference character 204*e* designates a bubbling liquid container containing a second liquid (bubbling liquid), which is so constructed that the bubbling liquid is fed to the respective heads from this container.

Provided under the respective heads are head caps 203*a* to 203*d* within which an ink-absorbing material is arranged. The caps are covered the discharge openings of the respective heads when recording is not conducted, whereby the head can be maintained.

Reference numeral 206 designates a conveyer belt constructing a conveying means for conveying various kinds of recording media as described in the preceding embodiments. The conveyer belt 206 is drawn around by various rollers through the predetermined course and driven by drive rollers connected to a motor driver 305.

In the ink-discharge recording system according to this embodiment, a pretreating apparatus 251 and a post-treating apparatus 252 for conducting various treatments before and after the recording are provided respectively on the upstream and downstream sides of the conveying course of the recording medium.

The contents of the pretreatment and post-treatment vary according to the kind of the recording medium on which recording is conducted, and the kinds of inks used. For example, for recording media such as metals, plastics and ceramics, they are exposed to ultraviolet light and ozone as a pretreatment to activate their surfaces, whereby their ink receptivity can be improved. Recording media easy to be charged with static electricity, such as plastics, readily attract dust to their surfaces due to the static electricity. In some cases, good recording may be prevented by the dust. Therefore, it is preferable that the static electricity on the recording media be removed by means of an ionizer as a pretreatment, thereby removing the dust from the recording media. When cloth is used as a printing medium, it is necessary to apply a substance selected from among alkaline substances, water-soluble substances, synthetic polymers, water-soluble metal salts, urea and thiourea to the cloth as a pretreatment in view of blotting prevention or fixation improvement. The pretreatments are not limited to these treatments. As a pretreatment, the temperature of a recording medium may be controlled to a temperature suitable for the recording.

On the other hand, the post-treatment includes a fixing treatment for facilitating the fixing of inks for a recording medium on which inks have been applied, such as a heat treatment or exposure to ultraviolet light, and a washing treatment for removing a treating agent applied in the pretreatment and left without reacting.

In this embodiment, the description has been made with the full-line heads, to which, however, the invention is not limited, and the apparatus may be so constructed that a small heads as described above is moved in the width direction of a recording medium to conduct recording.

The present invention will hereinafter be described more specifically by the following examples. Incidentally, all designations of "part" or "parts" as will be used in the following examples mean part or parts by weight unless expressly noted.

EXAMPLE 1

Three parts of dimethyl silicone oil containing a component represented by the general formula

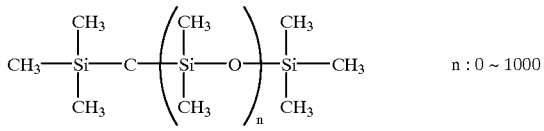

n : 0 ~ 1000 were added to 97 parts of cyclohexane, which is a nonpolar solvent, to prepare a second liquid to be fed to a second liquid flow path as a bubbling liquid.

A water-based ink was then prepared with the following components in accordance with a method known per se in the art to provide a first liquid to be fed to a first liquid flow path.

| Composition of water-based ink | |
|---|---|
| C.I. Food Black 2 | 5 parts |
| Glycerol | 10 parts |
| Diethylene glycol | 10 parts |
| Water | 75 parts. |

A combination of the first and second liquids was used to conduct liquid-discharge recording by means of an apparatus equipped with a head having a construction illustrated in FIG. 5, in which the volume ratio of the first liquid to the second liquid in a droplet discharged at a time was 90:10, to obtain print samples having many solid printed areas of 1×1 cm in dimensions on plain paper.

The analysis of the recorded images thus obtained revealed that each dot has such a structure that a droplet of the second liquid is discharged so as to cover the droplet of the first liquid, namely, a structure that the dot of the first liquid was coated with the second liquid.

COMPARATIVE EXAMPLE 1

Only the water-based ink used in Example 1 was used, namely, the water-based ink was supplied to both first liquid flow path and second liquid flow path, to conduct the same liquid-discharge recording as in Example 1, thereby obtaining print samples.

Evaluation Test Example 1

The recorded images on the print samples obtained in Example 1 and Comparative Example 1 were evaluated as to the following items.

1) Water fastness:

Each print sample was tilted at an angle of 45° with the image side upward, and 1 ml of water was dropped thereon in such a manner that water droplets slide down along the image side, thereby observing whether running of the coloring material occurred or not. As a result, it was found that running of the coloring material is scarcely observed in the print sample of Example 1. Thus good water resistance is was obtained On the other hand, running of the coloring material was observed in the print sample of Comparative Example 1.

2) Gloss of image

Gloss of each print sample was visually evaluated. As a result, it was found that the print sample of Example 1 was improved in gloss compared with the print sample of Comparative Example 1.

3) Rub-off resistance

A print sample was prepared in the same manner as in Example 1 except that a pigment was used as a coloring material in place of C.I. Food Black 2 to obtain improved in rub-off resistance. The printed surface of this print sample was rubbed 5 times with an eraser to evaluate the degree of rub-off of the image. As a result, there was no problem with this print sample. On the other hand, the print sample of Comparative Example 1 was faded at the printed area.

EXAMPLE 2

A first liquid (a water-based ink) to be fed to a first liquid flow path was prepared with the following components.

| Composition of first liquid | |
|---|---|
| Disperse toner*) | 50 parts |
| Diethylene glycol | 10 parts |
| Glycerol | 10 parts |
| Water | 30 parts. |

*)A disperse toner prepared by mixing 10 parts of MCF88 (trade name, product of Mitsubishi Kagaku Co., Ltd.), 10 parts of a styrene-acrylic copolymer resin (molecular weight: 8,000 product of Seiko Chemical Industries Co., Ltd. and 80 parts of water.

Using the water-based ink as the first liquid and cyclohexane as the second liquid, liquid-discharge recording was conducted by means of the same apparatus as used in Example 1. At the time, conditions for electric pulse signals applied to the heating element in response to recording information were variously changed to determine the volume of a droplet discharged at a time. As a control, only the first liquid was used, namely, the water-based ink was supplied to both first liquid flow path and second liquid flow path, to conduct the same liquid-discharge recording as described above. As a result, it was found that when the water-based ink and cyclohexane were used, the volume of a droplet discharged at a time under the same pulse conditions is increased by about 10% compared with the case where only the water-based ink was used.

Pulse signals by which the same discharge volume was achieved were compared in these cases. As a result, it was found that when the water-based ink and cyclohexane were used, the intensity of the pulse signals were made lower compared with the case where only the water-based ink was used.

A liquid discharging method and a head according to the present invention, where the first liquid is used as a discharging liquid, and the second liquid is used as a bubbling liquid, can drastically reduce the consumption of the second liquid, prevent the change of the characteristics of the discharge liquid, and thus can maintain proper liquid discharge for a long period of time. Further, according to the present invention, a droplet containing not only the first liquid but also the second liquid can be formed, and respective effects of the first and second liquids can be exhibited on a recording medium such as paper and a liquid receiving layer.

As described above, the separation state of the liquid to be fed to the bubbling region and the liquid not passing through the bubbling region or present in the displacing region of a movable member in a head is ensured by a difference in properties between these liquids. Thus functional separation of these liquids is further made significant, and the advantage brought about by the use of two liquids can be further enlarged.

Further, when the combination of the above-described two liquids is suitably selected, bright, high-quality and water-proof recording can be achieved. Besides, thickening and crusting at the discharge opening of a head can be prevented more effectively. In addition, good gloss can be imparted to the resulting recorded image.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid discharging method comprising the steps of:

providing a first liquid and a second liquid;

providing a liquid-discharge head comprising;

a liquid-discharging opening;

a first region containing the first liquid;

a bubble-generating region where the second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening; and discharging at least the first liquid from the liquid discharging opening, wherein the first and the second liquids have no compatibility with each other.

2. The liquid discharging method according to claim 1, wherein the free end is situated more downstream than the area center of the heating element as to the liquid flow.

3. The liquid discharging method according to claim 1, wherein a part of the generated bubble extends to the first liquid flow path as the movable member undergoes displacement.

4. The liquid discharging method according to claim 1, wherein the formed bubble is in contact with the movable member which is displacing during the displacement of the movable member.

5. The liquid discharging method according to any one of claims 1 to 4, wherein the bubble is a bubble generated by a film boiling phenomenon caused by heat transmitted from the heating element to the liquid.

6. The liquid discharging method according to claim 1, wherein the second liquid is supplied along a substantially flat or smooth inner wall situated more upstream than the heating element.

7. The liquid discharging method according to claim 1, wherein the whole effective area for bubbling of the heating element faces a movable region of the movable member.

8. The liquid discharging method according to claim 1, wherein the whole surface of the heating element faces a movable region of the movable member.

9. The liquid discharging method according to claim 1, wherein the supporting point of the movable member is situated away from right over the heating element.

10. The liquid discharging method according to claim 1, wherein the free end of the movable member is arranged closer to the discharge opening than right over the heating element.

11. The liquid discharging method according to claim 1, wherein the liquid supplied to the second liquid flow path is excellent in at least one property selected from low viscosity, bubbling ability and heat stability compared with the first liquid supplied to the first liquid flow path.

12. The liquid discharging method according to claim 1, wherein the first liquid is an amphoteric ink, and the second liquid is a hydrophilic ink.

13. The liquid discharging method according to claim 1, wherein the first liquid is an amphoteric ink, and the second liquid is a hydrophobic ink.

14. The liquid discharging method according to claim 1, wherein the first liquid is a hydrophilic ink, and the second liquid is an amphoteric ink.

15. The liquid discharging method according to claim 1, wherein the first liquid is a hydrophobic ink, and the second liquid is an amphoteric ink.

16. The liquid discharging method according to claim 1, wherein one of the first liquid and the second liquid is a hydrophilic ink, and the other is a hydrophobic ink.

17. A liquid discharge head comprising:

a first liquid;

a second liquid;

a liquid-discharging opening;

a first region containing the first liquid;

a bubble-generating region where the second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening, wherein the first and the second liquids have no compatibility with each other.

18. The liquid-discharge head according to claim 17, wherein the first liquid is an amphoteric ink, and the second liquid is a hydrophilic ink.

19. The liquid-discharge head according to claim 17, wherein the first liquid is an amphoteric ink, and the second liquid is a hydrophobic ink.

20. The liquid-discharge head according to claim 17, wherein the first liquid is a hydrophilic ink, and the second liquid is an amphoteric ink.

21. The liquid-discharge head according to claim 17, wherein the first liquid is a hydrophobic ink, and the second liquid is an amphoteric ink.

22. The liquid-discharge head according to claim 17, wherein one of the first liquid and the second liquid is a hydrophilic ink, and the other is a hydrophobic ink.

23. The liquid-discharge head according to claim 17, wherein the free end of the movable member is situated on the more downstream side than the area center of the heating element.

24. The liquid-discharge head according to claim 17, wherein the head has a supply path starting more upstream than the heating element for supplying the second liquid to the heating element.

25. The liquid-discharge head according to claim 24, wherein the supply path has a substantially flat or smooth inner wall more upstream than the heating element to supply the liquid to the heating element along the inner wall.

26. The liquid-discharge head according to claim 17, wherein the bubble is a bubble generated by film boiling caused by heat generated by the heating element.

27. The liquid-discharge head according to claim 17, wherein the movable member is in the form of a plate.

28. The liquid-discharge head according to claim 17, wherein the whole effective area for bubbling of the heating element faces a movable region of the movable member.

29. The liquid-discharge head according to claim 17, wherein the whole surface of the heating element faces a movable region of the movable member.

30. The liquid-discharge head according to claim 17, wherein the whole area of a movable region of the movable member is greater than the whole area of the heating element.

31. The liquid-discharge head according to claim 17, wherein the supporting point of the movable member is situated not right over the heating element.

32. The liquid-discharge head according to claim 17, wherein the free end of the movable member has a form substantially perpendicular to the liquid flow path in which the heating element has been arranged.

33. The liquid-discharge head according to claim 17, wherein the free end of the movable member is arranged closer to the discharge opening than right over the heating element.

34. The liquid-discharge head according to claim 17, wherein the movable member is constructed as a part of a partition wall arranged between the first liquid flow path and the second liquid flow path.

35. The liquid-discharge head according to claim 34, wherein the partition wall is composed of a metallic material, a resin or a ceramic.

36. The liquid-discharge head according to claim 35, wherein the metallic material is nickel or gold.

37. The liquid-discharge head according to claim 17, wherein a first common liquid chamber for supplying a plurality of the first liquid flow paths with the first liquid and a second common liquid chamber for supplying a plurality of the second liquid flow paths with the second liquid are arranged separately from each other in the head.

38. A liquid discharging method comprising the steps of:

providing a first liquid and a second liquid;

providing a liquid-discharge head comprising;

a liquid-discharging opening;

a first region containing the first liquid;

a bubble-generating region where the second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening; and discharging at least the first liquid from the liquid discharging opening, wherein the first region and the second region are substantially closed each other when the movable member is in the first position, and wherein the first and the second liquids have no compatibility with each other.

39. A liquid-discharge head comprising:

a first liquid:

a second liquid;

a liquid-discharging opening;

a first region containing the first liquid;

a bubble-generating region where the second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening, wherein the first region and the second region are substantially closed each other when the movable member is in the first position, and wherein the first and the second liquids have no compatibility with each other.

40. An ink-jet recording method comprising the steps of:

providing a first liquid and a second liquid;

providing a liquid-discharge head comprising;

a liquid-discharging opening;

a first region containing the first liquid;

a bubble-generating region where the second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening; and discharging at least the first liquid from the liquid discharging opening, wherein the first region and the second region are substantially closed each other when the movable member is in the first position, and wherein the first and the second liquids have no compatibility with each other, and wherein the first liquid is an ink containing a coloring material.

41. A head for ink-jet head comprising:

a first liquid;

a second liquid;

a liquid-discharging opening;

a first region containing the first liquid;

a bubble-generating region where the second liquid is contained, and bubbles are generated in the second liquid; and a movable member having a free end and a support part disposed upstream from the free end, and the movable member being displaceable from a first position facing the bubble-generating region to a second position away from the bubble-generating region in the first region when bubbles are generated in the second liquid in the bubble-generating region, and the movable member displaced in the second position leading the bubbles in the second region toward the liquid-discharging opening, wherein the first region and the second region are substantially closed each other when the movable member is in the first position, and wherein the first and the second liquids have no compatibility with each other, and wherein the first liquid is an ink containing a coloring material.

42. The liquid discharging method according to claims 1 or 38, wherein the first liquid and the second liquid make a clear interface when they contact each other.

43. The liquid-discharge head according to claims 17 or 39, wherein the first liquid and the second liquid make a clear interface when they contact each other.

44. The ink-jet recording method according to claim 40, wherein the first liquid and the second liquid make a clear interface when they contact each other.

45. The head according to claim 41, wherein the first liquid and the second liquid make a clear interface when they contact each other.

* * * * *

UNITED STATES PATENT AND TRADEMARK OFFICE

CERTIFICATE OF CORRECTION

PATENT NO. : 6,070,970

DATED : June 6, 2000

INVENTOR(S) : MASASHI OGASAWARA, ET AL.

It is certified that error appears in the above-identified patent and that said Letters Patent is hereby corrected as shown below:

COLUMN 1:

Line 27, "It" should read --There--; and
Line 43, "provides" should read --provide--.

COLUMN 2:

Line 60, "and the" should read --and--.

COLUMN 3:

Line 9, "has" should read --have--.

COLUMN 4:

Line 35, "closed each" should read --close to each--; and
Line 53, "closed each" should read --close to each--.

COLUMN 5:

Line 7, "closed each" should read --close to each--;
Line 26, "closed each" should read --close to each--; and
Line 60, "reunite" should read --reunite with--.

COLUMN 6:

Line 6, "by leaps and bounds" should be deleted.

UNITED STATES PATENT AND TRADEMARK OFFICE

CERTIFICATE OF CORRECTION

PATENT NO. : 6,070,970

DATED : June 6, 2000

INVENTOR(S) : MASASHI OGASAWARA, ET AL.

It is certified that error appears in the above-identified patent and that said Letters Patent is hereby corrected as shown below:

COLUMN 7:

Line 61, "dimensions," should read --dimension),--.

COLUMN 15:

Line 15, close up right margin;
Line 16, close up left margin; and
Line 18, "suitable" should read --suitably--.

COLUMN 16:

Line 22, "merits further" should read --further merits--; and
Line 37, "it" should read --there--.

COLUMN 17:

Line 66, "the both" should read --both--.

COLUMN 18:

Line 58, "included are" should read --are included--.

COLUMN 19:

Line 20, "10 In" should read --10. ¶In--;
Line 31, "liquid," should read --liquids,--;
Line 33, "it is" should read --there are--; and
"a" should be deleted; and
Line 37, "Am" should read --μm--.

UNITED STATES PATENT AND TRADEMARK OFFICE

CERTIFICATE OF CORRECTION

PATENT NO. : 6,070,970

DATED : June 6, 2000

INVENTOR(S) : MASASHI OGASAWARA, ET AL.

It is certified that error appears in the above-identified patent and that said Letters Patent is hereby corrected as shown below:

COLUMN 20:

Line 18, "coexist" should read --to coexist--; and
Line 54, "an" should read --a--.

COLUMN 21:

Line 17, "understood" should read --understand--.

COLUMN 26:

Line 3, "temporally" should read --temporarily--.

COLUMN 27:

Line 54, "heads" should read --head--.

COLUMN 28:

Line 55, "is" should be deleted; and
Line 67, "improved in" should read --improved--.

COLUMN 29:

Line 21, "Ltd. and" should read --Ltd.) and--.

COLUMN 30:

Line 15, "comprising;" should read --comprising:--; and
Line 30, "liquid dis-" should read --liquid-dis---.

UNITED STATES PATENT AND TRADEMARK OFFICE

CERTIFICATE OF CORRECTION

PATENT NO. : 6,070,970

DATED : June 6, 2000

INVENTOR(S) : MASASHI OGASAWARA, ET AL.

It is certified that error appears in the above-identified patent and that said Letters Patent is hereby corrected as shown below:

COLUMN 32:

Line 41, "comprising;" should read --comprising:--;
Line 57, "liquid dis-" should read --liquid-dis---; and
Line 60, "closed each" should read --close to each--.

COLUMN 33:

Line 16, "closed each" should read --close to each--;
Line 21, "comprising;" should read --comprising:--;
Line 38, "liquid dis-" should read --liquid-dis---; and
Line 41, "closed each" should read --close to each--.

COLUMN 34:

Line 24, "closed each" should read --close to each--.

Signed and Sealed this

Eighth Day of May, 2001

*Attest:*

Nicholas P. Godici

NICHOLAS P. GODICI

*Attesting Officer*

*Acting Director of the United States Patent and Trademark Office*